US009706290B2

(12) United States Patent
Grinker

(10) Patent No.: US 9,706,290 B2
(45) Date of Patent: Jul. 11, 2017

(54) BALANCED ARMATURE BASED VALVE

(71) Applicant: Apple Inc., Cupertino, CA (US)

(72) Inventor: Scott C. Grinker, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/010,759

(22) Filed: Jan. 29, 2016

(65) Prior Publication Data

US 2016/0255433 A1 Sep. 1, 2016

Related U.S. Application Data

(60) Provisional application No. 62/265,860, filed on Dec. 10, 2015, provisional application No. 62/126,396, filed on Feb. 27, 2015.

(51) Int. Cl.
*H04R 1/28* (2006.01)
*H04R 1/10* (2006.01)
(Continued)

(52) U.S. Cl.
CPC ..... *H04R 1/2873* (2013.01); *H04R 1/1016* (2013.01); *H04R 1/1075* (2013.01);
(Continued)

(58) Field of Classification Search
CPC ..... H04R 9/025; H04R 9/027; H04R 7/00; H04R 2207/00; H04R 7/06; H04R 7/04
(Continued)

(56) References Cited

U.S. PATENT DOCUMENTS 3,432,622 A 3/1969 Sebesta et al.
6,853,735 B2 2/2005 Imahori et al.
(Continued)

FOREIGN PATENT DOCUMENTS

EP 2134107 A2 12/2009
EP 2134107 A3 7/2012
(Continued)

OTHER PUBLICATIONS

PCT Search Report and Written Opinion (dated May 18, 2016), International Application No. PCT/US2016/016641, International Filing Date—Feb. 4, 2016, 13 pages.

*Primary Examiner* — Suhan Ni
(74) *Attorney, Agent, or Firm* — Blakely, Sokoloff, Taylor & Zafman LLP

(57) ABSTRACT

A balanced armature ("BA") based valve is described. The valve includes a motor having a coil assembly and a magnetic system, an armature extending through or being located adjacent to the motor, a drive pin coupled to the armature, and a valve flap of a membrane having a hole therein. The valve flap is actuated by the drive pin into open and closed positions, in response to respective motions of the armature. A housing contains the motor, the armature, the drive pin, and the membrane. In one embodiment, the membrane is attached to the housing and divides the housing into an upper space and a lower space, and there is airflow through the hole, between the upper space and the lower space, only when the valve flap is open. A first spout of the housing may deliver sound generated by an acoustic driver in the housing into a wearer's ear canal, and is also open to the upper space. A second spout of the housing is open to the bottom space and to an ambient environment. Other embodiments are also described.

13 Claims, 21 Drawing Sheets

(51) Int. Cl.
*H04R 11/02* (2006.01)
*H04R 25/00* (2006.01)

(52) U.S. Cl.
CPC ..... *H04R 11/02* (2013.01); *H04R 25/456* (2013.01); *H04R 2225/025* (2013.01); *H04R 2225/43* (2013.01); *H04R 2460/03* (2013.01); *H04R 2460/11* (2013.01)

(58) Field of Classification Search
USPC ..... 381/417–424, 429, 431
See application file for complete search history.

(56) References Cited

U.S. PATENT DOCUMENTS

| | | | | |
|---|---|---|---|---|
| 7,206,425 | B2 | 4/2007 | Vaudrey et al. | |
| 7,899,203 | B2 * | 3/2011 | Van Halteren | H04R 11/02 381/418 |
| 8,098,854 | B2 * | 1/2012 | van Halteren | H04R 1/24 381/418 |
| 8,548,186 | B2 | 10/2013 | Alwicker et al. | |
| 8,798,304 | B2 | 8/2014 | Miller et al. | |
| 2010/0322454 | A1 | 12/2010 | Ambrose et al. | |
| 2012/0057734 | A1 | 3/2012 | Ambrose et al. | |
| 2014/0205131 | A1 | 7/2014 | Azmi et al. | |

FOREIGN PATENT DOCUMENTS

| | | | |
|---|---|---|---|
| EP | 2747455 | A2 | 6/2014 |
| EP | 2747455 | A3 | 12/2014 |
| GB | 1057853 | A | 2/1967 |
| WO | WO-2010042613 | A2 | 4/2010 |
| WO | WO-2010042613 | A3 | 4/2010 |

* cited by examiner

BALANCED ARMATURE BASED VALVE

This non-provisional application claims the benefit of the earlier filing dates of U.S. provisional application 61/126,396 filed Feb. 27, 2015 and 62/265,860 filed Dec. 10, 2015.

FIELD

Embodiments described herein relate to an in-ear speaker (e.g., an earbud, a hearing aid, a personal sound amplifier (PSAP), etc.). More particularly, the embodiments described herein relate to an in-ear speaker having a balanced armature (BA) based venting or acoustic pass valve. Other embodiments are also described.

BACKGROUND INFORMATION

An in-ear speaker (e.g., an earbud, a hearing aid, a personal sound amplifier (PSAP), etc.) that includes at least one acoustic driver can be designed to deliver sounds to one or more ears of a user of such an in-ear speaker. These types of in-ear speakers can also be designed with uplink capabilities that enable telecommunication functionalities for phone calls, video calls, and the like. Users of these types of in-ear speakers can be subjected to unwanted sounds resulting from an occlusion effect, as a result of their use of these types of in-ear speakers which block the ear canal. Additionally, users of these types of in-ear speakers can be prevented from being aware of auditory stimuli in their immediate surroundings when using these types of in-ear speakers. Moreover, the power consumption of these types of in-ear speakers is suboptimal.

SUMMARY

Embodiments of a balanced armature (BA) based valve for use in an in-ear speaker are described.

For one embodiment, a "balanced armature based valve," a "BA based valve," and their variations refer to a bi-stable electrical device or system that includes a motor having a coil assembly and a magnetic system; an armature extending through or being located adjacent to the coil assembly and the magnetic system; and a drive pin. A first end of the drive pin is coupled to the armature and a second end of the drive pin is coupled to a valve flap that covers a hole in a membrane, such that the valve flap is actuated by the drive pin into an open position (in which the hole is uncovered allowing airflow through the hole) based on a first motion of the armature, and a closed position (in which the hole is completely covered thereby preventing airflow through the hole) based on a second motion of the armature. A housing contains the motor, the armature, the drive pin, and the membrane. A first spout is coupled to or formed on the housing such that the first spout is open to an ear canal and to a top face of the membrane inside the housing; and a second spout is coupled to or formed on the housing such that the second spout is open to the ambient environment outside of the housing and to an opposite (bottom) face of the membrane inside the housing.

In one embodiment, the membrane divides the space inside the housing into an upper space that is open to the top face of the membrane, and a lower space that is open to the bottom face of the membrane. The first spout is open to the upper space, and the second spout is open to the bottom space. When the valve flap is in the open position, there is airflow from the upper space to the lower space through the uncovered hole; when the valve flap is in the closed position, the airflow (through the hole) stops. In the case where the valve is used in a sealing type in-ear speaker, the ear canal of the wearer of the in-ear speaker becomes sealed off from the ambient environment when the valve flap is in the closed position.

For an embodiment, the BA based valve is included in an in-ear speaker (e.g., an earbud, a hearing aid, etc.) For an embodiment, the BA based valve is included in a driver assembly, where the driver assembly also includes at least one acoustic driver. The acoustic driver may be configured to share the first spout (with the BA based valve) as a primary acoustic output port of the acoustic driver, to convert a user content audio signal into sound that is delivered into the ear canal of the wearer. For one embodiment, the at least one acoustic driver can include any type of acoustic driver—e.g., a BA receiver, a moving coil driver/receiver, an electrostatic driver/receiver, an electret driver/receiver, an orthodynamic driver/receiver, etc. For one embodiment, the driver assembly is included in an in-ear speaker (e.g., an earbud, a hearing aid, etc.).

For one embodiment, the opening of the valve flap is used to mitigate one or more amplified or echo-like sounds created by an occlusion effect, the latter being caused by for example an in-ear speaker that is blocking the ear canal of its wearer. For one embodiment, the opening or closing of the valve flap is used to enable a listener to manipulate his perception of audio transparency.

For one embodiment, logic controls or works, together with a sensor, to trigger the opening or closing of the valve flap. For one embodiment, the logic is included in the BA based valve, in the in-ear speaker (e.g., an earbud, a hearing aid, etc.) that includes the BA based valve, or in an external device that is providing input signals, such as a user content audio signal and a valve drive or control signal, to the BA based valve (or to the in-ear speaker that contains the BA based valve.) For one embodiment, the sensor is included in the BA based valve, in the in-ear speaker that includes the BA based valve, or in the external device that is providing the input signals.

For one embodiment, the BA based valve can be part of an active vent system that couples a user's ear canal to an ambient environment via a pathway. The pathway includes one or more volumes between a sealed ear canal and the ambient environment. For one embodiment, an "active vent system" and its variations refer to an acoustic system that couples a sealed ear canal volume to a volume representing an external ambient environment (outside of an ear or an electronic device) using a pathway. For one embodiment, a "pathway" and its variations refer to a simple network of volumes connected to the BA based valve. For example, and for one embodiment, an active vent system requires a minimal amount of pathways (i.e., volumes) to connect a sealed ear canal volume with a volume representing an external ambient environment (outside of an ear or an electronic device). For one embodiment, a "volume" and its variations refer to a dynamic air pressure confined within a specified three dimensional space, wherein the volume is represented as an acoustic impedance. Depending on a geometry of the volume, the volume's acoustic impedance can behave like a compliance, inertance, (also known as "acoustic mass"), or a combination of both. The specified three dimensional space can be expressed in a tangible form as a tubular structure, a cylindrical structure, or any other type of structure with a defined boundary.

Other features or advantages of the embodiments described herein will be apparent from the accompanying drawings and from the detailed description that follows below.

BRIEF DESCRIPTION OF THE DRAWINGS

Embodiments described herein are illustrated by way of example and not limitation in the figures of the accompanying drawings, in which like references indicate similar features. Furthermore, in the figures, some conventional details have been omitted so as not to obscure from the inventive concepts described herein. Also, in the interest of conciseness and reducing the total number of figures, a given figure may be used to illustrate the features of more than one embodiment of the invention, and not all elements in the figure may be required for a given embodiment

DETAILED DESCRIPTION

Figure 1A:
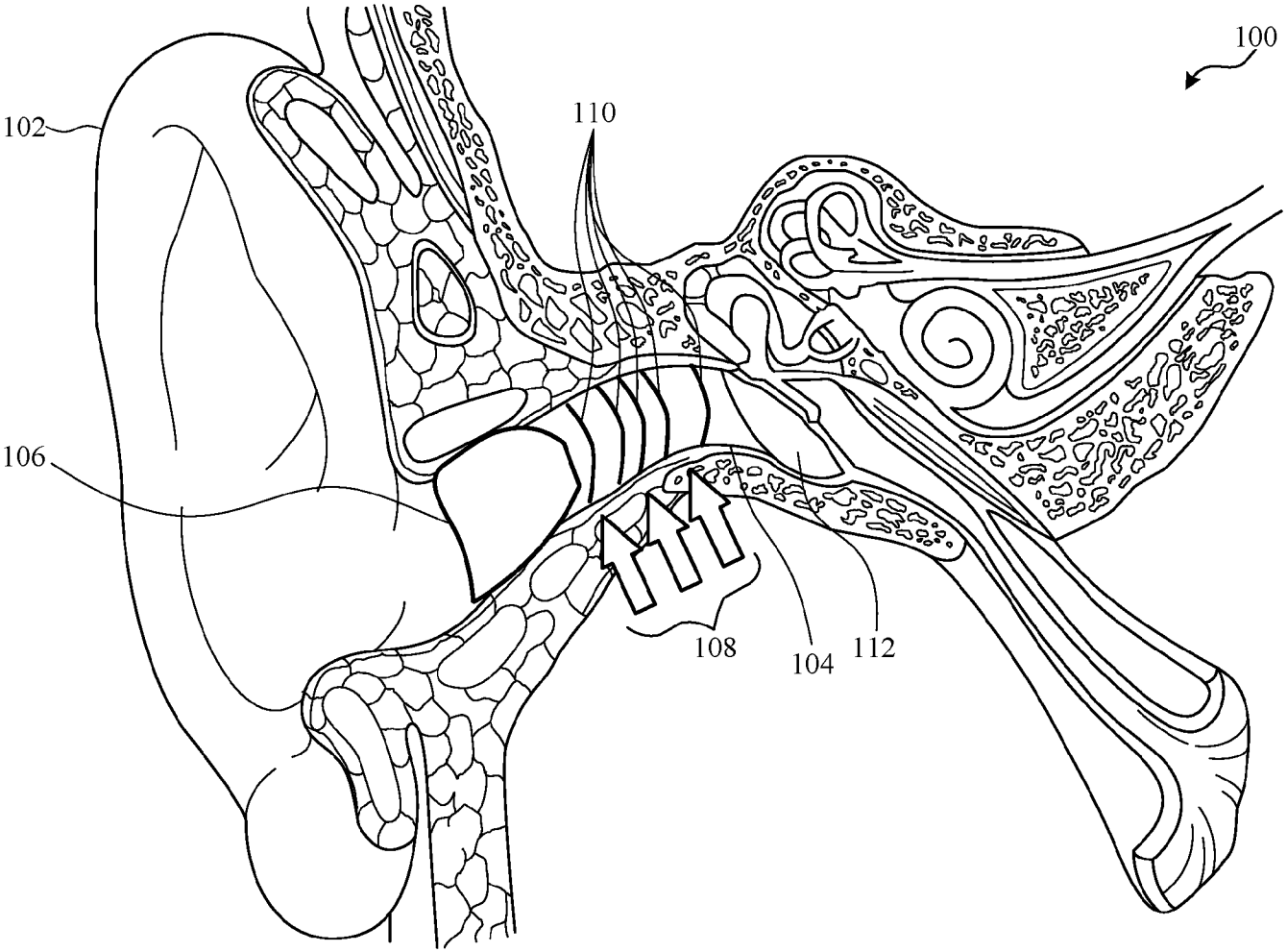
FIGS. 1A-1B are illustrations of an occlusion effect in an ear canal.

Various embodiments of a balanced armature (BA) based valve (hereinafter "BA based valve") are described. The embodiments of the BA based valve described herein can be included in an in-ear speaker (e.g., an earbud, a hearing aid, etc.). The embodiments of the BA based valve described herein can be included in a driver assembly, where the driver assembly also includes at least one acoustic driver. The at least one acoustic driver can include any type of acoustic driver—e.g., a BA receiver, a moving coil driver/receiver, an electrostatic driver/receiver, an electret driver/receiver, an orthodynamic driver/receiver, etc. The embodiments of the BA based valve described herein can assist with mitigating one or more amplified or echo-like sounds created by an occlusion effect. The embodiments of the BA based valve described herein can be used to assist with enabling a listener to manipulate his perception of audio transparency. The embodiments of the BA based valve described herein can be operated using logic that controls or works together with a sensor. Furthermore, the embodiments of the BA based valve described herein can be part of an active vent system that couples a user's ear canal to an ambient environment via a pathway. The pathway can include one or more volumes between a sealed ear canal and the ambient environment.

Description of at least one of the embodiments set forth herein is made with reference to figures. However, certain embodiments may be practiced without one or more of these specific details, or in combination with other known methods and configurations. In the following description, numerous specific details are set forth, such as specific configurations, dimensions and processes, etc., in order to provide a thorough understanding of the embodiments. In other instances, well-known processes and manufacturing techniques have not been described in particular detail in order to not unnecessarily obscure the embodiments. Reference throughout this specification to "one embodiment," "an embodiment," "another embodiment," "other embodiments," "some embodiments," and their variations means that a particular feature, structure, configuration, or characteristic described in connection with the embodiment is included in at least one embodiment. Thus, the appearances of the phrase "for one embodiment," "for an embodiment," "for another embodiment," "in other embodiments," "in some embodiments," or their variations in various places throughout this specification are not necessarily referring to the same embodiment. Furthermore, the particular features, structures, configurations, or characteristics may be combined in any suitable manner in one or more embodiments.

The terms "over," "to," "between," and "on" as used herein may refer to a relative position of one layer with respect to other layers. One layer "over" or "on" another layer or bonded "to" or in "contact" with another layer may be directly in contact with the other layer or may have one or more intervening layers. One layer "between" layers may be directly in contact with the layers or may have one or more intervening layers.

For one embodiment, a "balanced armature based valve," a "BA based valve," and their variations refer to a bi-stable electrical device or system that includes a motor comprising a coil assembly and a magnetic system; an armature extending through or being located adjacent to the coil assembly and the magnetic system; a drive pin having a first end of the drive pin coupled to the armature and a second end of the drive pin coupled to a valve flap of a membrane such that the valve flap is actuated by the drive pin into an open position based on a first motion of the armature or a closed position based on a second motion of the armature; a housing containing the motor, the armature, the drive pin, and the membrane; a first spout coupled to or formed on the housing such that the first spout is configured to deliver one or more sound waves to an ear canal; and a second spout coupled to or formed on the housing such that the second spout is configured to deliver one or more sound waves that are inside the ear canal to an ambient environment.

For one embodiment, an "active vent system" and its variations refer to an acoustic system that couples a sealed ear canal volume to a volume representing an external ambient environment (outside of an ear or an electronic device) using a pathway.

For one embodiment, a "pathway" and its variations refer to a simple network of volumes connected to the BA based valve. For example, and for one embodiment, an active vent system requires a minimal amount of volumes to connect a sealed ear canal volume with a volume representing an external ambient environment (outside of an ear or an electronic device).

For one embodiment, a "volume" and its variations refer to a dynamic air pressure confined within a specified three dimensional space, wherein the volume may be represented as an acoustic impedance. Depending on a geometry of the volume, the volume's acoustic impedance can behave like a compliance, inertance, (also known as "acoustic mass"), or combination of both. The specified three dimensional space can be expressed in a tangible form as a tubular structure, a cylindrical structure, or any other type of structure with a defined boundary.

For one embodiment, an "in-ear speaker" and its variations refer to electronic devices for providing sound to a user's ear. In-ear speakers are aimed into an ear canal of the user's ear and may or may not be inserted into the ear canal. An in-ear speaker may include acoustic drivers, microphones, processors, and other electronic devices. An in-ear speaker may be wired or wireless (for purposes of receiving a user content audio signal from an external device). In-ear speakers include, but are not limited to, earphones, earbuds, hearing aids, hearing instruments, in-ear headphones, in-ear monitors, canalphones, personal sound amplifiers (PSAPs), and headsets.

For one embodiment, an "insertable in-ear speaker" and its variations refer to an in-ear speaker that is inserted into an ear canal. This can be achieved via a specified three dimensional space (e.g., a tubular structure, a cylindrical structure, any other type of structure known for facilitating insertion into an ear canal, etc.).

For one embodiment, a "sealable insertable in-ear speaker" and its variations refer to an insertable in-ear speaker that fully seals an ear canal, e.g, via a flexible or resilient tip. Sealable insertable in-ear speakers prevent sounds from an ambient environment from leaking into an ear canal during use in an ear canal. Sealable insertable in-ear speakers can also result in an occlusion effect during use in an ear canal.

For one embodiment, a "leaky insertable in-ear speaker" and its variations refer to insertable in-ear speaker that is intentionally designed to allow some sounds from the ambient environment to leak into the user's ear canal during use. Leaky insertable in-ear speakers provide better natural audio transparency than sealable insertable in-ear speakers.

For one embodiment, "audio transparency" and its variations refer to a phenomenon that occurs when a user can hear all of the sounds around him including sounds from the ambient environment and sounds being delivered into his ear canal by an in-ear speaker.

For one embodiment, an "acoustic driver" and its variations refer to a device including one or more transducers for converting electrical signals into sound. Acoustic drivers include, and are not limited to, a moving coil driver/receiver, a balanced armature (BA) receiver, an electrostatic driver/receiver, an electret driver/receiver, and an orthodynamic driver/receiver. Acoustic drivers can be included in an in-ear speaker.

In one aspect, the embodiments of BA based valve as described herein are incorporated into an in-ear speaker which may also be part of a personal communication device or any portable electronic device that has an audio function which converts audio signals into sound. In one aspect, at least one of the embodiments of a BA based valve as described herein are incorporated into a driver assembly comprised of one or more acoustic drivers. In one aspect, the driver assembly includes at least one embodiment of a BA based valve as described herein and at least one of (i) one or more BA receivers known in the art; or (ii) one or more acoustic drivers that are not BA receivers (e.g., one or more acoustic drivers that are of the electrodynamic type.) For example, one embodiment of a BA based valve as described herein is included in a driver assembly, such as one of the driver assemblies described in U.S. patent application Ser. No. 13/746,900 (filed Jan. 22, 2013), which was published on Jul. 24, 2014 as U.S. Patent Application Publication No. 20140205131 A1.

For one embodiment, the BA based valve and the one or more acoustic drivers included in the driver assembly are housed in a single housing of the driver assembly. For one embodiment, a first spout is formed on or coupled to a housing of the driver assembly and is shared by the BA based valve and by one or more of the acoustic drivers. For one embodiment, the first spout is to deliver sound that is output/generated by the acoustic driver housed in the driver assembly to an ear canal. The driver assembly includes a second spout that is formed on the housing of the driver assembly and is primarily used by the BA based valve described herein. For one embodiment, the second spout is to deliver sound from the ear canal out into the ambient environment. For one embodiment, the second spout assists with delivering unwanted sound created by an occlusion effect into the ambient environment that is outside of the ear canal. For one embodiment, the second spout assists with manipulation of the listener or wearer's perceived audio transparency. For one embodiment, the second spout assists with regulation of ear pressure caused by pressure differences in the listener's ear.

At least one of the aspects described above enables a single, electrical input audio signal (that corresponds to or reflects a desired sound) to be fed into one or multiple acoustic drivers, in the driver assembly, for conversion into sound. Furthermore, the single electric signal can be electrically filtered using different filters (e.g., a high-pass filter, a low-pass filter, a band-pass filter, etc.) and each of the different types of filtered audio signals can be fed to a respective one or more of the multiple acoustic drivers in the driver assembly (e.g., a tweeter, a woofer, a super woofer, etc.). The filtering can be performed using a crossover circuit that filters the input audio signal into the different types of output filtered signals, fed to the one or more corresponding multiple acoustic drivers in the driver assembly. Moreover, a driver assembly that includes at least one of the embodiments of a BA based valve described herein can assist with reduction or elimination of amplified or echo-like sounds created by an occlusion effect, as well as, manipulation of perceived audio transparency.

Figure 1B:
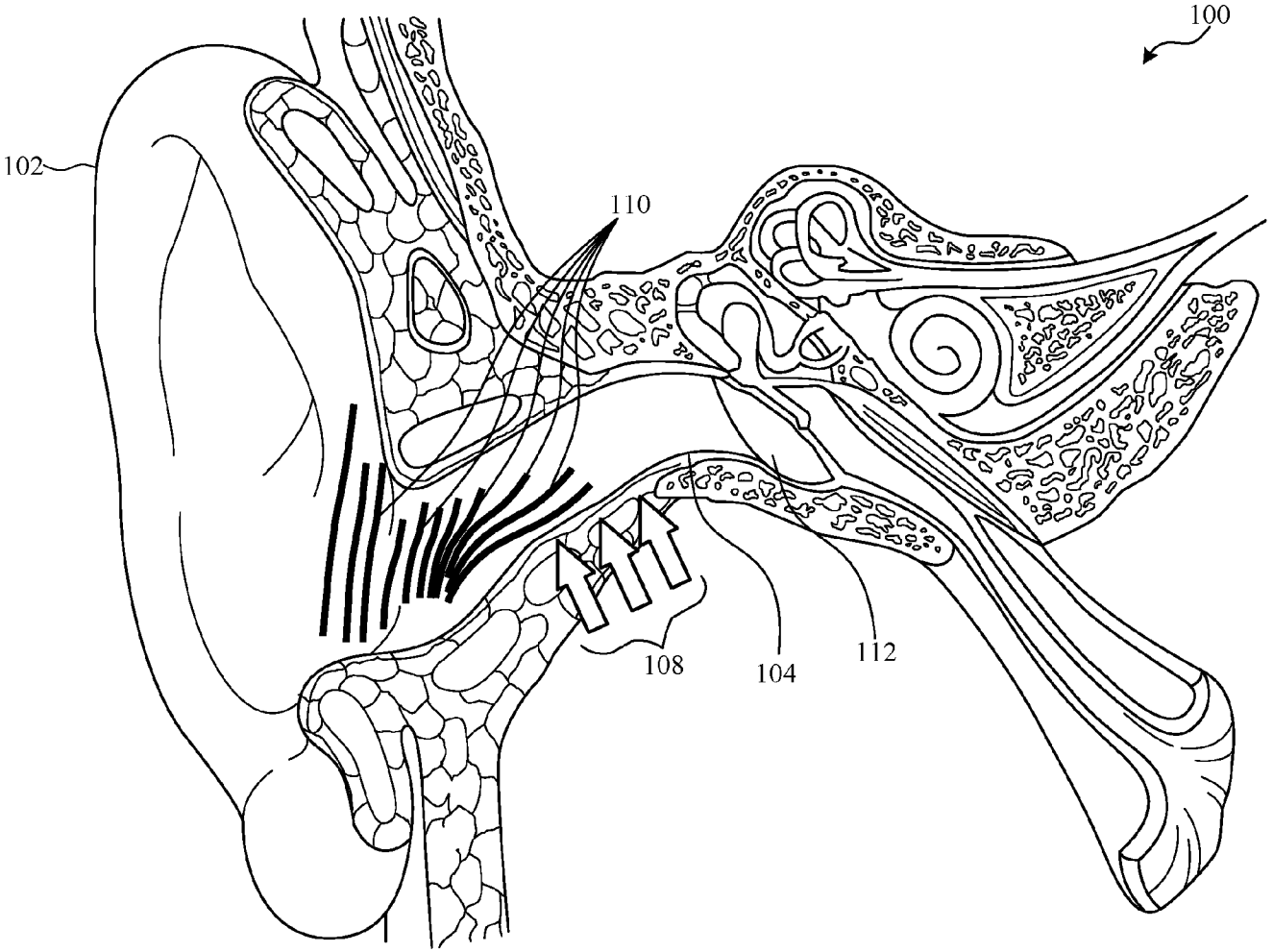

FIGS. 1A-1B are illustrations of an occlusion effect 100 in an ear canal 104 of a listener's ear 102. With regard to FIG. 1A, the occlusion effect 100 occurs when an in-ear speaker 106 fills the outer portion of the ear canal 104 causing the listener to perceive amplified or echo-like sounds 110 of the listener's own voice (e.g., when the listener is talking, etc.) or amplified or echo-like sounds 110 created in the listener's mouth (e.g., sounds created by chewing food, sounds created due to a movement of a listener's body, etc.). Specifically, the occlusion effect 100 is caused by bone-conducted sound vibrations 108 reverberating off the in-ear speaker 106 filling the ear canal 102. The amplified sounds 110 are caused by the volume of air between the tympanic membrane and the in-ear speaker 106 filling the ear canal 104 becoming excited from bone and tissue conduction.

In order to deliver a desired sound that is produced by the in-ear speaker 106 to a listener's eardrum 112, the in-ear speaker 106 in one embodiment seals the ear canal 104. In other words, the in-ear speaker 106 fills the ear canal 104 to prevent sound from escaping outside the ear 102. The sealing of the ear canal 104 can be beneficial for preventing loss of low frequency sounds, whose absence can affect the quality of the desired sound being delivered to the ear. Nevertheless, one consequence of a sealed ear condition is the occlusion effect 100, which can interfere with a listener's ability to enjoy or perceive the desired audio.

As shown in the open ear canal case of FIG. 1B, the occlusion effect 100 is not noticeable to most listeners when they are talking or engaged in an activity, because in the open ear canal case the vibrations 108 that cause amplified sounds 110 escape through the open ear canal 104 into the ambient environment. In FIG. 1A, however, when the ear canal 104 is sealed or blocked by the in-ear speaker 106, the vibrations 108 cannot exit the ear canal 104, and as a result, the sounds 110 become amplified or echo-like because they are reflected back toward the eardrum 112 in the ear 102. Compared to the completely open ear canal 104 in FIG. 1B, the occlusion effect 100 can boost low frequency sound pressure (usually below 500 Hz) in the ear canal 100 by 20 dB or more, as described below in connection with FIGS. 3A-3C.

Some users of in-ear speakers, such as the in-ear speaker 106, may find the amplified or echo-like sounds created by the occlusion effect 100 to be annoying and distracting when they are listening to sound delivered by such in-ear speakers. Thus, several ways to mitigate or eliminate the occurrence of an occlusion effect are presently utilized. One way to reduce or eliminate the occurrence of the occlusion effect includes combining the in-ear speaker 106 in FIGS. 1A-1B with an active noise control or acoustic noise cancellation ("ANC") processor and its associated, error microphone, both of which are not shown in FIGS. 1A-1B. The error microphone can pick up the unwanted, amplified sounds 110 created by the occlusion effect 100, which are then converted to digital audio signals and processed by the ANC processor to create an anti-phase estimate of the unwanted, amplified sounds 110; the anti-phase estimate is then converted into a sound field by an acoustic driver of the in-ear speaker 106, in hopes of destructively interfering with and therefore reducing the unwanted sounds 110 created by the occlusion effect 100. This way of reducing the occlusion effect 100 however requires the use of digital signal processing ("DSP"), which can result in a level of power consumption that is not ideal for some types of in-ear speakers (e.g., a size-critical in-ear speaker, a wireless in-ear speaker, etc.).

Figure 2:
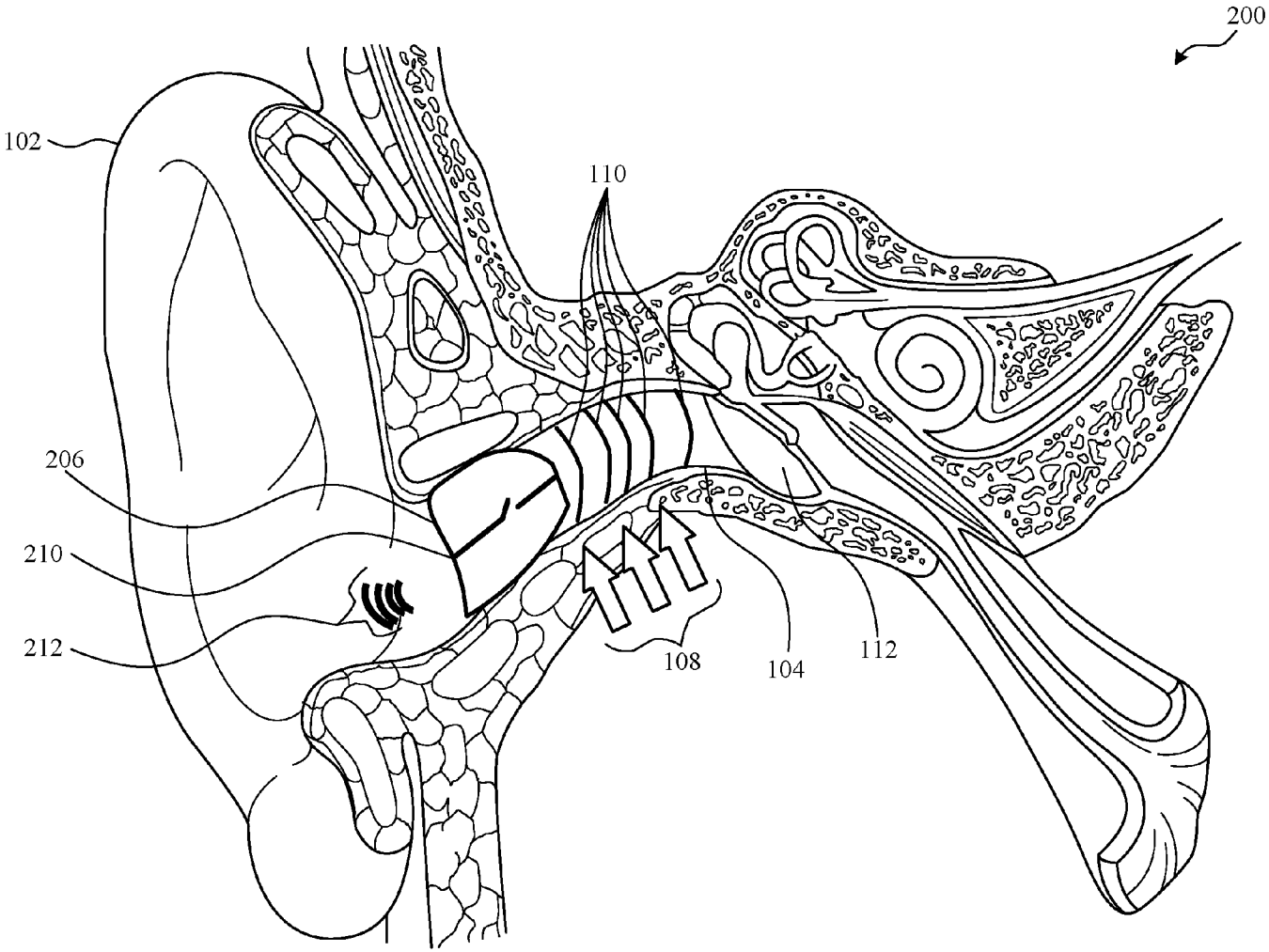
FIG. 2 is an illustration of an in-ear speaker including one embodiment of a balanced armature based valve (hereinafter "BA based valve").

FIG. 2 is an illustration of an in-ear speaker 206 including one embodiment of a venting or acoustic passBA based valve 210 that can assist with mitigating or eliminating an occlusion effect 200 in an ear canal 104. FIG. 2 is a modification of FIGS. 1A-1B, which are described above. In contrast with the in-ear speaker 106 of FIG. 1A, the in-ear speaker 206 includes a venting or acoustic passBA based valve 210 that acts as a switching valve that can be signaled (switched) open, in order to allow some of the amplified or echo-like sounds 110 to escape (vent or pass) into the ambient environment instead of being reflected onto the eardrum 112. The escaped sounds 212 consequently reduce (or even eliminate) the amplified or echo-like sounds 110 that are perceived by the listener. In this way, the occlusion effect 200 can be reduced or eliminated. The in-ear speaker 206 can include the BA based valve 210 and at least one acoustic driver—e.g., a BA receiver, a moving coil driver/receiver, an electrostatic driver/receiver, an electret driver/receiver, an orthodynamic driver/receiver, etc.

For one embodiment, the BA based valve 210 is a bi-stable electrical device or system that consumes a minimal amount of power, when compared with the system described above having an ANC processor and an error microphone. Specifically, and for one embodiment, a magnetic motor of the BA based valve 210 is designed to be bi-stable, so that the power consumption of the BA based valve 210 occurs only when the BA based valve 210 is moving or transitioning between its two states as an open valve or a closed valve. For this embodiment, power is not needed when the BA based valve 210 is not changing from a closed position to an open position and vice versa. In this way, the BA based valve 210 can be used to reduce or eliminate the occlusion effect in an in-ear speaker 206, without the increased levels of power consumption associated with an ANC processor and an error microphone. Additional details about the bi-stable operation of one embodiment of the BA based valve 210 are described below in connection with FIGS. 5A-7B. The BA based valve 210 illustrated in FIG. 2 can be similar to or the same as at least one of the BA based valves described below in connection with at least one of FIGS. 5A-17.

Figure 3A:
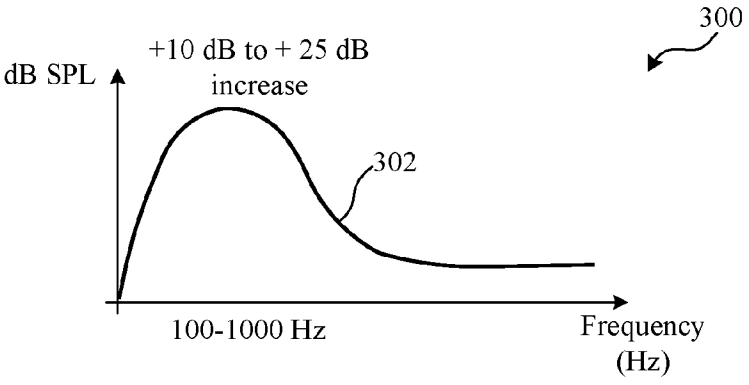
FIGS. 3A-3C are charts illustrating sound levels in an ear canal based on FIGS. 1A, 1B, and 2, respectively.
Figure 3B:
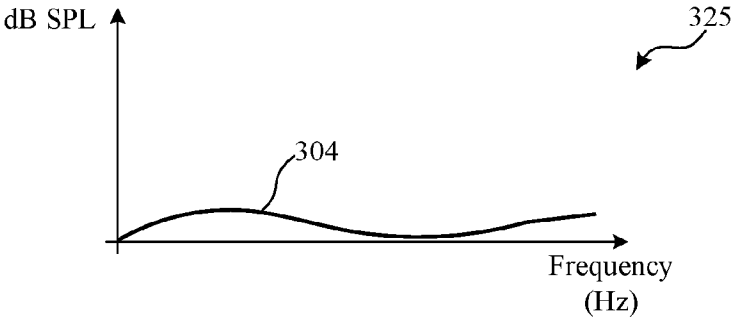
Figure 3C:
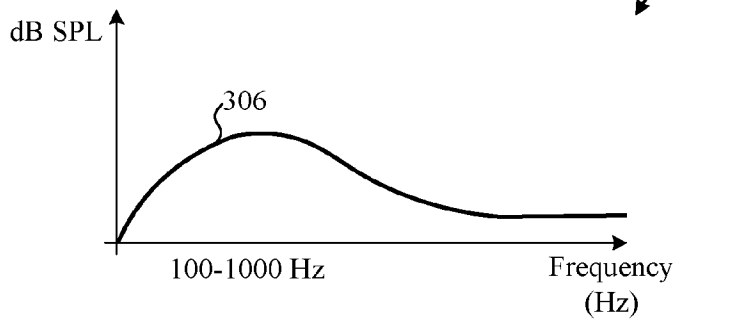

FIGS. 3A, 3B, and 3C are charts illustrating sound levels in a listener's ear canal based on the occlusion effects described above in FIGS. 1A, 1B, and 2, respectively. With regard to FIGS. 3A and 3B, a comparison of curve 302 with curve 304 shows that low frequency sounds between 100 Hz and 1000 Hz that would normally escape from a completely open ear canal 104 become amplified when the occlusion effect 100 is caused by a sealing of the ear canal 104 by the in-ear speaker 106. Specifically, curve 302 shows that low frequency sounds between 100 Hz and 1000 Hz are amplified by as little as 10 dB SPL (sound pressure level) to as much as 25 dB SPL.

With regard to FIG. 3C, curve 306 represents the level of sound amplification attributable to the occlusion effect 200 that is caused when one embodiment of the in-ear speaker 206 seals the ear canal 104. A comparison of curve 306 with curve 304 shows that the low frequency sounds between 100 Hz and 1000 Hz are amplified less severely when the in-ear speaker 206 seals the ear canal 104 than when the in-ear speaker 106 seals the ear canal 104. For one embodiment, the cause of the less severe amplification is due to the BA based valve 210 acting as a switching valve within the in-ear speaker 206.

Figure 4:
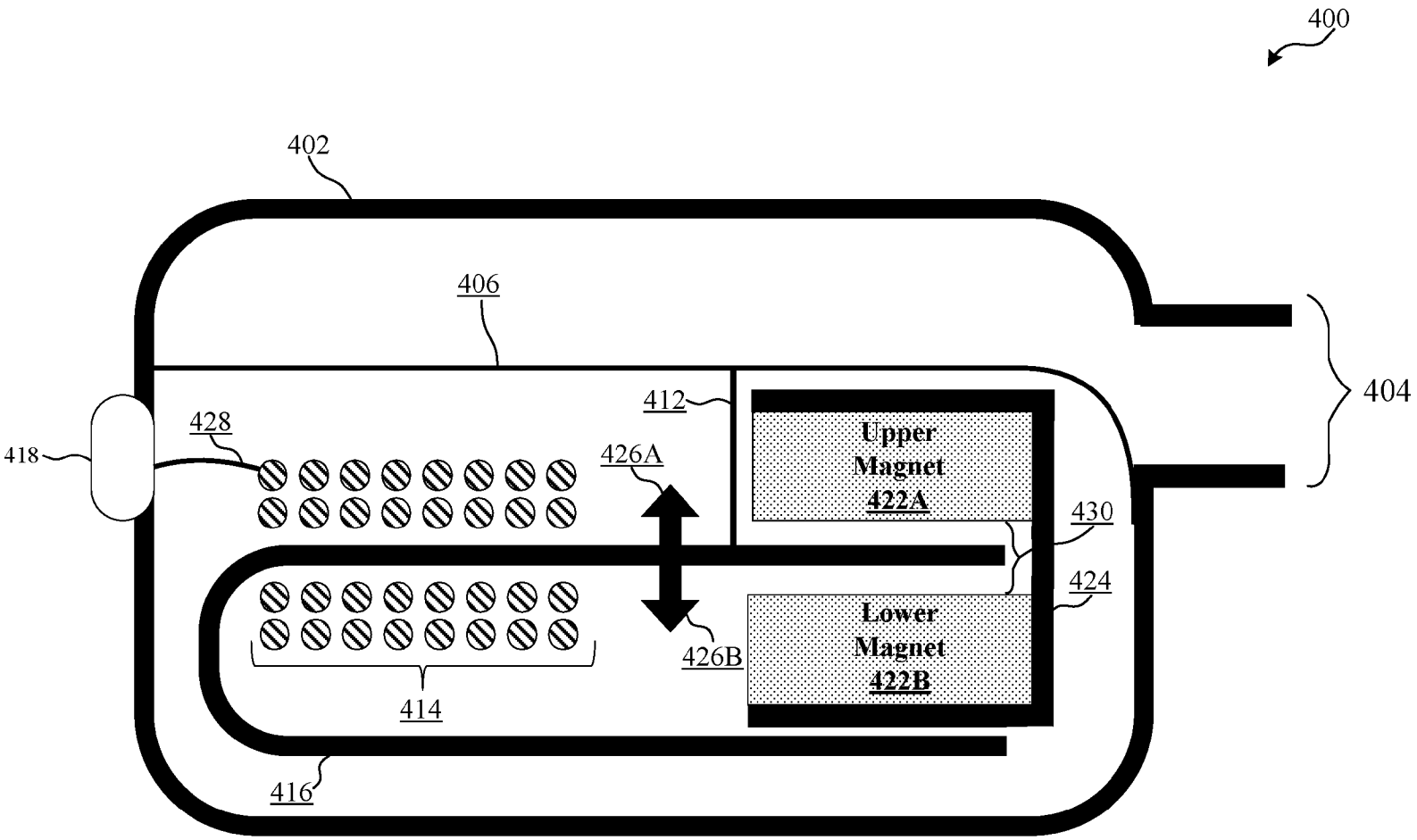
FIG. 4 (PRIOR ART)
FIG. 4 is a cross-sectional side view illustration of an exemplary acoustic driver that is presently utilized.

FIG. 4 is a cross-sectional side view illustration of an exemplary acoustic driver 400 that is presently utilized. The in-ear speaker may contain the acoustic driver 400, thereby enabling its wearer to hear user content such as a telephone call conversation or a musical work (reflected in an audio signal at the input of the acoustic driver 400). The specific type of acoustic driver 400 that is illustrated in FIG. 4 is a balanced armature (BA) receiver. The acoustic driver 400, however, is not so limited. This acoustic driver 400 can be any type of acoustic driver—e.g., a BA receiver, a moving coil driver/receiver, an electrostatic driver/receiver, an electret driver/receiver, an orthodynamic driver/receiver, etc.

The acoustic driver 400 includes a housing 402 that holds, encases, or is attached to one or more of the components of the acoustic driver 400. Furthermore, and for one embodiment, the housing 402 includes a top side, a bottom side, a front side, and a rear side. For one embodiment, the front side of the housing 402 is substantially parallel to the rear side of the housing 402, while the top side of the housing 402 is substantially parallel to the bottom side of the housing 402. When the acoustic driver 400 is part of an in-ear speaker that is placed in a user's ear, the rear side of the housing 402 is further away from the user's ear canal than the front side of the housing 402 and the rear side of the housing 402 is closer to an ambient environment than the front side of the housing 402.

In the illustrated example of the acoustic driver 400, a spout 404A is formed on or attached to the front side of housing 402; a terminal 418 is formed on or attached to the rear side of housing 402; the spout 404A is closer to the top side of housing 502; and the spout 404A is farther from the bottom side of housing 402. The spout 404 is formed on or welded to housing 402 to enable one or more sound waves, that have been converted from one or more electrical signals received through a terminal 418 by acoustic driver 400, to be delivered or emitted into an ear of a listener (e.g., ear 102 of FIGS. 1A-2) or into the ambient environment. The acoustic driver 400 outputs the sound waves using a membrane or diaphragm (hereinafter "membrane") 406, a drive pin 412, a coil assembly 414, an armature or a reed (hereinafter "armature") 416, a terminal 418, and a magnetic system. The magnetic system of the acoustic driver 400 includes an upper magnet 422A, a lower magnet 422B, a pole piece 424, and an air gap 430. The acoustic driver 400 also includes an electrical wire or cable or connector 428 that may directly connect the terminal 418 to the coil assembly 428. The terminal 418 is electrically connected to a flex circuit (not shown) that provides the electrical audio signal as input to the acoustic driver 400. The flex circuit (not shown) may be used to carry a crossover circuit and/or an audio amplifier whose outputs provide the one or more electrical input audio signals that produce the coil current in the acoustic driver 400. The crossover circuit and/or the amplifier may be connected to one or more external devices such as a smartphone (e.g., via a direct wired interface, or via a digital wireless audio interface) that generate the one or more electrical input audio signals. It is to be appreciated that the crossover circuit is not always necessary, especially when the electrical input audio signal is not being filtered.

Operation of the acoustic driver 400 begins when the one or more electrical input audio signals are received at the terminal 418 and directed into the coil assembly 414, via the connector 428. In response to receiving the electrical input audio signal (coil current), the coil assembly 414 produces electromagnetic forces that trigger a movement of the armature 416 in the directions 426A and 426B in the air gap 430. Generally, the magnetic system of the acoustic driver 400 (which includes the upper magnet 422A, the lower magnet 422B, the pole piece 424, and the air gap 430) is tuned to prevent the armature 416 from being in contact with either of the magnets 422A-B. In this way, the armature 416 oscillates between the magnets 422A-B.

The drive pin 412, which is connected to the armature 416 and the membrane 406, moves as a result of (e.g., in direct proportion to) the oscillating movements of the armature 416. The movements of the drive pin 412 cause vibrations or movements of the membrane 406, which create sound waves in the air above the membrane 406, in proportion to the variation in the input audio signal (coil current). The sound waves created by the membrane 406 travel through the spout 404 into an ear of a listener or out into the ambient environment.

The coil assembly 414 can, for example, be a coil winding that is wrapped around a bobbin or any other type of coil assembly known in the art. The armature can be placed adjacent to or through the coil assembly 414. The armature 416 can be optimized based on its shape or configuration to enable production of a broad band of sound frequencies (e.g., low, mid-range, high frequencies, etc.). Furthermore, the drive pin 412 can be connected to the membrane 406 using an adhesive or any other coupling mechanism known in the art.

For one embodiment, the acoustic driver 400 is included in an in-ear speaker. One disadvantage of the acoustic driver 400 is that it cannot reduce the occlusion effect if it is included in an in-ear speaker. Furthermore, the acoustic driver 400 may have to be combined, in the in-ear speaker, with an ANC processor and an error microphone to reduce occlusion effects, as described above. Any in-ear speaker that includes acoustic driver 400 might have to include additional space for the DSP components associated with an ANC processor and an error microphone. The acoustic driver 400, therefore, can increase the size of an in-ear speaker. The acoustic driver 400 can also increase the cost of producing an in-ear speaker because it may need to be electrically connected to an ANC processor, an error microphone, and other DSP components.

Figure 5A:
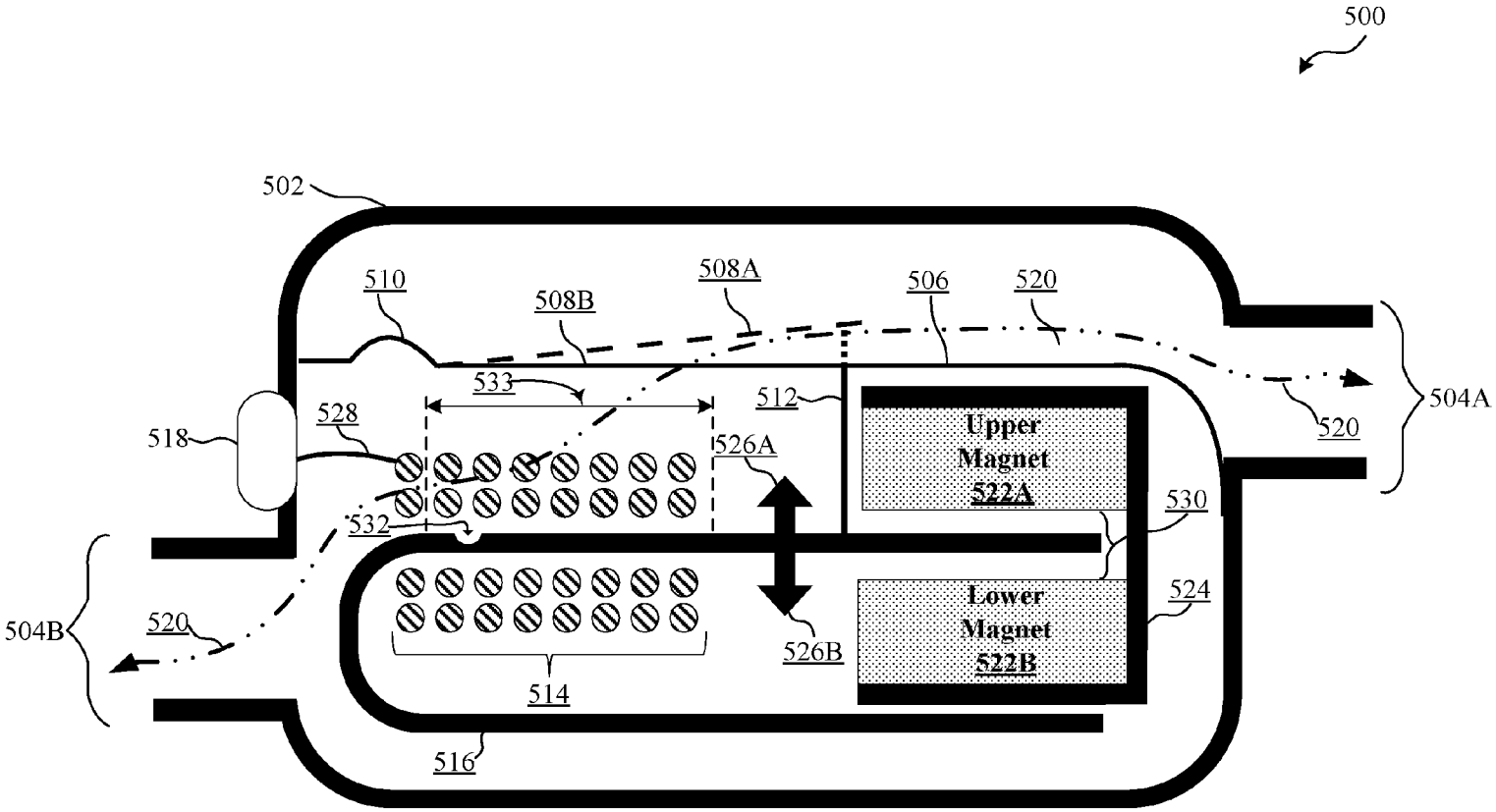
FIG. 5A is a cross-sectional side view illustration of one embodiment of a BA based valve.

FIG. 5A is a cross-sectional side view illustration of one embodiment of a BA based valve 500. The BA based valve 500 is a modification of the acoustic driver 400 of FIG. 4. For the sake of brevity, only the differences between the acoustic driver 400 (which is described above in connection with FIG. 4) and the BA based valve 500 will be described below in connection with FIG. 5.

Some differences between the acoustic driver 400 (which is described above) and the BA based valve 500 relates to the presence of two spouts 504A-B, a membrane 506 (including a valve flap 508 and a hinge 510), an armature 516, a coil assembly 514, two magnets 522A-B, a pole piece 524, and an air gap 530 in the BA based valve 500. For a first example, and for one embodiment, the valve flap 508 of the membrane 506 of the BA based valve 500 can be in an open position 508A or a closed position 508B, while the membrane 406 of the acoustic driver 400 lacks any valve flap or other mechanism capable of being opened or closed. For a second example, and for one embodiment, the membrane 506 of the BA based valve 500 does not vibrate to create sound, while the membrane 406 of the acoustic driver 400 vibrates to create sound.

For one embodiment, the BA based valve 500 includes two spouts 504A and 504B, which may be formed on or coupled to the housing 502 as is known in the art. For the illustrated embodiment of the BA based valve 500, the spout 504A is formed on or coupled to the front side of the housing 502; the spout 504B and a terminal 518 (which is to receive a valve drive or control signal) are formed on or attached to the rear side of the housing 502; the spout 504A is closer to the top side of the housing 502; the spout 504A is farther from the bottom side of the housing 502; and the spout 504B is closer to the bottom side of the housing 502.

For one embodiment, the spout 504A is similar to or the same as the spout 404, which is described above in FIG. 4. For one embodiment, the spout 504A works in combination with the spout 504B to diffuse amplified or echo-like sounds that are created by an occlusion effect, outward into an ambient environment or away from a listener's ear canal so as to mitigate or eliminate the unwanted sounds. For one embodiment, the spout 504B is similar to the spout 404 (which is described above in FIG. 4); however, the spout 504B does not face the ear canal of the listener. For this embodiment, spout 504B faces outward or opens to the ambient environment to enable amplified sound waves created by an occlusion effect to be delivered or emitted into the ambient environment away from the ear canal of the listener.

The amplified or echo-like sound created by an occlusion effect is diverted into the ambient environment through a hole in the membrane 506, when the valve flap 508 is open. When the flap 508 is closed, sound from the ambient environment is restricted from entering the ear canal (assuming the ear canal is otherwise sealed by the in-ear speaker). The valve flap 508 of the membrane 506 is open at the position 508A, and closed at the position 508B; in the latter position the flap 508 lies flat against and abuts, or seals against, the top face of the main portion or primary portion of the membrane 506, and is positioned so as to completely cover the hole that is formed in the main portion of the membrane 506 as shown. For one embodiment, the hinge 510 is created as part of the main portion of the membrane 506 (e.g., integral with a sheet that makes up the rest of the membrane 506), is joined to what may be described as a "fixed end" of the flap 508 which may be opposite a "free end" of the flap 508), and is sufficiently flexible or compliant to enable the opening and closing of the valve flap 508, for example by virtue of acting as a fixed, pivot axis for the flap 508, which can pivot between its open and closed positions 508A, 508B. For one embodiment, when the valve flap 508 is in the open position 508A, there is airflow between the spouts 504A-B through the hole in the membrane that is directly underneath the flap 508, so as to divert some or all of the amplified or echo-like sounds created by an occlusion effect out away from a listener's ear canal. In this way, the BA based valve 500 can enable a listener to reduce an occlusion effect, when desired.

For one embodiment, an in-ear speaker that includes the BA based valve 500 can enable manipulation of a listener's perceived audio transparency based on the opening or closing of the valve flap 508. For one embodiment of an in-ear speaker that includes the BA based valve 500, when the valve flap 508 is in the open position 508A, a listener can made aware of auditory stimuli in his surroundings because sound waves from the ambient environment can travel through the housing 502 generally along a sound transmission path 520 that connects the two spouts 504A-B. For this embodiment, the listener is still receiving ambient sounds, and as a result, his perception of audio transparency is enhanced. For one embodiment of an in-ear speaker that includes the BA based valve 500, when the valve flap 508 is in the closed position 508B, the BA based valve 500 acts as an ambient noise blocker, for a listener that does not want to perceive auditory stimuli from his surroundings. For this embodiment, the listener will receive only the sounds that are being actively generated or produced by an acoustic driver of the in-ear speaker, which can be beneficial in certain situations. In this way, the BA based valve 500 can enable a listener to reduce an occlusion effect when desired, become aware of sounds in the ambient environment when desired, or prevent sounds from the ambient environment from reaching the listener's ear canal when desired.

For one embodiment, an in-ear speaker that includes the BA based valve 500 can assist with regulation of ear pressure caused by pressure differences in a listener's ear based on the opening or closing of the valve flap 508. Pressure differences in a listener's ear can result from pressure changes in the ambient environment, e.g., as the listener using an in ear-speaker moves—such as in an aircraft's cabin—from a lower elevation with one level of pressure to a higher elevation that has a different level of pressure, etc. When wearing an in-ear speaker, such ambient pressure changes can be uncomfortable, or even painful. For one embodiment, an in-ear speaker that includes the BA based valve 500 can regulate the pressure differences in the listener's ear when he is using the in-ear speaker. For one embodiment of an in-ear speaker that includes the BA based valve 500, when the valve flap 508 is in the closed position 508B, air flow to and from the ambient environment through the hole is prevented or sealed off and as such the listener's ear is isolated from ambient pressure changes (in the case where an outside surface of the in-ear speaker forms a seal against the wearer/listener's ear canal.) The isolation from ambient pressure changes is achieved, because airflow from the ambient environment is prevented from traveling through the housing 502, between the two spouts 504A-B. For example, and for one embodiment, the air pressure above the diaphragm of the in-ear speaker is thus isolated from or sealed off from the air pressure in the ambient environment, and as a result, the listener's inner ear is sealed off from ambient pressure change. When the valve flap 508 is actuated into the open position 508A, however, the listener's ear is no longer isolated from changes in ambient pressure. In this way, the BA based valve 500 can enable a listener to regulate changes in ear pressure that result from ambient pressure changes when desired, reduce an occlusion effect when desired, become aware of sounds in the ambient environment when desired, or prevent sounds from the ambient environment from reaching the listener's ear canal when desired.

For one embodiment, one or more of the control signals that cause the opening or closing of the valve flap 508 can be based on one or more measurements by one or more sensors (not shown) and based on an operating state of an external electronic device (e.g., a smartphone, a computer, a wearable computer system, or other sound source.) The external electronic device may be the source of a user content audio signal that is being delivered using a wired or a wireless link or connection between the external electronic device and the in-ear speaker. For one embodiment, the one or more sensors can include at least one of an accelerometer, a sound sensor, a barometric sensor, an image sensor, a proximity sensor, an ambient light sensor, a vibration sensor, a gyroscopic sensor, a compass, a barometer, a magnetometer, or any other sensor which may be installed within a housing of the in-ear speaker or within a housing of the external electronic device. A purpose is to detect a characteristic of one or more environs. For one embodiment, the one or more drive or control signals which are applied to the coil assembly 514 of the valve are based on one or more measurements by the one or more sensors. For one embodiment, the one or more sensors are included as part of the BA based valve 500, as part of an in-ear speaker that includes the BA based valve 500 (e.g., within the external housing of the in-ear speaker—not shown), or they may be part of the external electronic device (e.g., a smartphone, a computer, a wearable computer system, etc.) In the latter case, the valve drive or control signal may be provided from outside of the housing 502, to the BA based valve 500, through the terminal 518.

For one embodiment, the one or more sensors are coupled to logic that determines, based on one or more measurements by the one or more sensors, when one or more of the control signals that cause the opening or closing of the valve flap 508 are to be applied to the coil assembly 514 (or to another valve actuator). The logic circuitry can be included in the housing 502 of the BA based valve 500, in the housing of an in-ear speaker in which the BA based valve 500 is contained, or in the housing of an external electronic device (e.g., a smartphone, a tablet computer, a wearable computer system, etc.) that provides a user content electrical audio signal that may be converted to sound for a listener (by the in-ear speaker).

In a first example, and for one embodiment, the one or more sensors include a sound sensor (e.g., a microphone, etc.). In this first example, the BA based valve 500 is included in an in-ear speaker that is connected to an external electronic device that can play audio/video media files and conduct telephony (e.g., a smartphone, a computer, a wearable computer system, etc.). In this first example, the sound sensor may be included inside the housing 502 of the BA based valve 500, or it may be in the housing of the in-ear speaker that includes the BA based valve 500, or in the housing of the external electronic device (e.g., a smartphone, a computer, a wearable computer system, etc.). In this first example, the logic for determining whether the valve flap 508 is to be opened is included in at least one of the BA based valve 500, the in-ear speaker that includes the BA based valve 500, or the external electronic device (e.g., a smartphone, a computer, a wearable computer system, etc.). In this first example, the listener is listening to audio from the external electronic device (e.g., a smartphone, a computer, a wearable computer system, etc.) using an acoustic driver that is in the in-ear speaker. When the sound sensor detects the listener's voice for a threshold amount of time, the logic determines that the listener (with the in-ear speaker in his/her ear) may be engaged in a phone/video call or a conversation with another human. In this first example, the logic provides the one or more control signals that cause the valve flap 508 to be opened, in response to the determination that the listener is on a phone/video call or in a conversation with another human. In this way, the sound sensor, the logic, and the BA based valve 500 assist with a reduction of an occlusion effect that can occur when the listener (with the in-ear speaker in his/her ear) is engaged in a phone/video call or a conversation with another physical human.

In a second example, a software component running on the external electronic device (e.g., a smartphone, a computer, a wearable computer system, etc.) can determine an operating state of a software application (e.g., a media player application, a cellular telephony application, etc.) that is also running in the external device and that may be producing the user content audio signal. Based on this operating state, the software component can determine whether to open or close the valve flap 508 and will then signal the valve actuator (e.g., the coil assembly 514) accordingly. For one embodiment, the software component on the external electronic device can also use data from the one or more sensors (e.g., the sound sensor, an accelerometer, etc.) in addition to the operating state of the software application, to determine whether to open or close the valve flap 508. In this second example, and for one embodiment, the sound sensor initially detects no sound from the listener (e.g., the listener is not talking but is listening to audio from the in-ear speaker) and the software component determines one or more operating states of an application on the external electronic device. In this second example, and for one embodiment, one determined operating state is that a media player application is being used to generate the user content audio signal (that is being converted into sound by the acoustic driver in the in-ear speaker) as the listener is listening to audio; and another determined operating state is that a cellular telephony application is not being used, because no phone/video call has been placed or received. In this case, the software component can, based on the operating state of the applications and the data from the sound sensor, cause one or more control signals to be sent to a valve actuator (e.g., the coil assembly 514) to close the valve flap 508. Shortly after this, the operating state of an application on the external electronic device may change because a phone call begins (e.g., a call is placed or received using the cellular telephony application, etc.), and the sound sensor detects that the listener is speaking. In this further case, based on the change in the operating state of the application and the based on data from the sound sensor, the software component causes a control signal to be sent to the valve actuator to open the valve flap 508.

In a third example, and for one embodiment, the one or more sensors include a sound sensor and an accelerometer. In this third example, as in the second example given above, an acoustic driver of the in-ear speaker is connected to receive a user content audio signal from an external electronic device that can play audio/video media and act as a telecommunications device (e.g., a smartphone, a computer, a wearable computer system, etc.). The sound sensor is included in at least one of the valve 210 (e.g., the BA based valve 500), the in-ear speaker that includes the BA based valve 500, or the external electronic device (e.g., a smartphone, a computer, a wearable computer system, etc.). In this third example, the accelerometer is included in at least one of the BA based valve 500, the in-ear speaker that includes the BA based valve 500, or the external electronic device (e.g., a smartphone, a computer, a wearable computer system, etc.). In this third example, the logic for determining whether the valve flap 508 is to be opened can be included in at least one of the BA based valve 500, the in-ear speaker that includes the BA based valve 500, or the external electronic device (e.g., a smartphone, a computer, a wearable computer system, etc.). In this third example, the listener is watching a video and/or listening to audio from the external electronic device (e.g., a smartphone, a computer, a wearable computer system, etc.) using the in-ear speaker that includes the BA based valve 500. In this third example, the sound sensor does not detect the listener's voice for a threshold period of time, and the logic determines that the listener is not engaged in a phone/video call on the external electronic device and is not engaged in a conversation with another physical person. In addition, and in this third example, the accelerometer detects that the listener has been moving for a threshold period of time, and as a result, the logic determines that the listener is engaged in a physical activity (e.g., walking, running, lifting, etc.). In this second example, the logic in response to detecting physical activity by the listener provides one or more valve drive or control signals to the terminal 518 that cause the valve flap 508 to open, in response to the determination that the listener is engaged in a physical activity even though the listener is not engaged in a conversation with a physical human and not engaged in a phone/video call. In this way, the sound sensor, the accelerometer, the logic, and the BA based valve 500 assist with manipulation of audio transparency even when the listener (with the in-ear speaker in his/her ear) is not engaged in a phone/video call or a conversation with a physical human.

In a fourth example, and for one embodiment, the one or more sensors include a barometric sensor. In this fourth example, the BA based valve 500 is included in an in-ear speaker that is connected to an external electronic device (e.g., a smartphone, a computer, a wearable computer system, etc.). In this fourth example, the barometric sensor is included in at least one of the BA based valve 500, the in-ear speaker that includes the BA based valve 500, or the external electronic device (e.g., a smartphone, a computer, a wearable computer system, etc.). In this fourth example, logic for determining whether the valve flap 508 is to be opened or closed can be included in at least one of the BA based valve 500, the in-ear speaker that includes the BA based valve 500, or the external electronic device (e.g., a smartphone, a computer, a wearable computer system, etc.). In this fourth example, and for one embodiment, the listener is using the in-ear speaker that includes the BA based valve 500 with the external electronic device to perform an activity (e.g., watching a video, listening to audio, browsing the internet, etc.). In this fourth example, the barometric sensor detects a change in the ambient air pressure by a threshold amount and/or for a threshold period of time. In this fourth example, in response to measurements of the barometric sensor, the logic determines that the pressure changes in the listener's ear could be uncomfortable or painful for the listener. In this fourth example, the logic provides one or more of the signals that cause the closing of the valve flap 508 in order to assist with isolating the listener's ear pressure from the ambient pressure changes. For one embodiment, the logic provides the one or more valve drive or valve control signals to the terminal 518, in response to the determination that that the pressure changes in the listener's ear may be uncomfortable or painful for the listener. In this way, the barometric sensor, the logic, and the BA based valve 500 assist with regulation of pressure changes in a listener's ear.

For one embodiment, a programmed processor, or a software component being executed by a processor on the external electronic device (e.g., a smartphone, a computer, a wearable computer system, etc.), can analyze and/or gather data provided to or received by one or more software applications (e.g., an atmospheric pressure monitoring application, a weather monitoring application, etc.) that are running on the external electronic device. For one embodiment, based on the analyzed and/or gathered data, the software component determines whether to open or close the valve flap 508 and then sends an appropriate control signal to the coil assembly 514 (that controls the drive pin 512). In a fifth example, and for one embodiment, data is analyzed and/or gathered from a weather monitoring application that is receiving measurements of the atmospheric pressure in the listener's ambient environment from a network. In this fifth example, the software component determines that there has been a change in the atmospheric pressure for a threshold period of time and/or by a threshold amount based on the analyzed and/or gathered data. In this case, the software component can, based on the analyzed and/or gathered data, cause one or more control signals to be sent to the coil assembly 514 to close the valve flap 508. Now, shortly after this, assume that the analyzed and/or gathered data changes (e.g., the software component determines, using data from the weather monitoring application, that the atmospheric pressure has remained stable for a threshold amount of time). In this further case, based on the change in the analyzed and/or gathered data, the software component causes one or more control signals to be sent to the coil assembly to open the valve flap 508. In this way, the logic, the software component of the external electronic device, and the BA based valve 500 assist with regulation of pressure changes in a listener's ear.

Other examples and/or embodiments are also possible. It is to be appreciated that the immediately preceding examples are merely for illustration and are not intended to be limiting. This is because there are numerous types of sensors that cannot be listed or described herein; and because there are numerous ways in which the numerous types of sensors can be used and/or combined to trigger an opening or closing of the valve 210 (e.g., using the valve flap 508 in the case of the BA based valve 500.) It is also to be appreciated that one or more of the examples and/or embodiments described above can be combined or practiced without all of the details set forth in the examples and/or embodiments described above.

For one embodiment, the logic that determines, based on one or more measurements of the one or more sensors, when one or more of the signals that cause the opening or closing of the valve flap 508 are applied to the coil assembly 514 can be manually overridden by the listener, to open or close the valve flap 508 when the listener chooses. For example, and for one embodiment, an external electronic device (which is electrically connected to an in-ear speaker that includes the BA based valve 500) can include one or more input devices that enable a listener to provided one or more direct inputs that cause the logic to directly provide one or more control signals that cause the coil assembly 514 to open or close the valve flap 508 (as indicated by the direct inputs from the listener). For this embodiment, the logic is forced to provide the control signal to the valve actuator based one or more direct inputs that are provided to the external electronic device (containing the logic.) For one embodiment, the external electronic device includes, but is not limited to, the in-ear speaker that includes the BA based valve 500, a smartphone, a computer, and a wearable computer system.

For one embodiment of the BA based valve 500, as depicted in FIG. 5A for example, each of the membrane 506, the valve flap 508, the hinge 510, the armature 516, and the magnetic assembly (which includes the coil assembly 514, the two magnets 522A-B, the pole piece 524, and the air gap 530) is specially designed so that the armature 516 (and by extension, the drive pin 512) is operable in a bi-stable manner. For one embodiment, the bi-stable operation of the armature 516 results from an application of one or more electrical input or control signals, from a low power current source to the coil assembly 514, which in turn creates a magnetic flux that causes the armature to move upward 526A towards the upper magnet 522A or downwards 526B towards the magnet 522B. The magnets 522A-B are of sufficient magnetic strength to cause the armature 516 to make contact with the magnets 522A-B, and this causes the drive pin 512 to either actuate valve 508 into the open position 508A or the closed position 508B. To achieve this bi-stable operation, each of the membrane 506, the valve flap 508, the hinge 510, the armature 516, and the magnetic assembly of the BA based valve 500 are made from materials that result in an opening or a closing of the valve flap based on the low power current provided to the coil assembly 514, via the terminal 518. Additional details about the opening or the closing of the valve flap 508 based on a low power current are described below in connection with FIGS. 7A-7B.

For one embodiment, the membrane 506 has a substantially rectangular shape, is between the top and bottom sides of housing 502, and is approximately parallel or substantially parallel to the top and bottom sides of housing 502. Furthermore, and for one embodiment, each of the coil assembly 514, the armature 516, and the magnetic system of BA based valve 500 are between the membrane 506 and the bottom side of housing 502. For one embodiment, the membrane 506 is approximately 7.5 mm by 3.9 mm. For one embodiment, the membrane 506 is a multi-part assembly comprising a main part of the membrane 506 that may be attached to the housing 502 at its outermost periphery (and as a result divides the housing 502 into a top space and a bottom space), the valve flap 508, and the hinge 510. For one embodiment, the main part of the membrane 506 is made of one or more materials that make the main part of the membrane 506 sufficiently rigid, so that the main part does not move or vibrate in response to the movement of the drive pin 512 (while the flap 508 does). In one embodiment, the hinge 510 and the flap 508 may be made of the same material as the main part of the membrane 506, where the flap 508 is formed by cutting through a sheet that forms the membrane 506 along a distance that defines the free end of the flap 508. In that case, the attached end (fixed end) of the flap 508 defines the hinge 510; its geometry is modified (from that of the main part of the membrane 506) so that it exhibits the needed compliance for the flap 508 to pivot (between the open and closed positions.) Such flexibility or compliance in the hinge 510 may be achieved by for example forming a crimp in an aluminum sheet (where the main part of the membrane 506 is cut from an aluminum sheet), or forming cut-outs in the aluminum sheet; in the case where the membrane 506 is formed from a laminate sheet, the geometry of the hinge 510 could be formed by removing or omitting one or more layers of the laminate in the region that defines the hinge 510.

For one embodiment, the main part of the membrane 506 is made from at least one of Biaxially-oriented polyethylene terephthalate (hereinafter "BoPET"), aluminum, copper, nickel, or any other suitable material or alloy known in the art. For one embodiment, the valve flap 508 is made from BoPET, aluminum, copper, nickel, or any other suitable material or alloy known in the art. For one embodiment, the hinge 510 is made from BoPET, aluminum, copper, nickel, or any other suitable material or alloy known in the art. For one embodiment, each of the main part of the membrane 506 and the hinge 510 is formed using a metal forming process, e.g., electroforming, electroplating, etc. For one embodiment, the valve flap 508 is formed on the membrane 506 using an etching process, e.g. laser marking, mechanical engraving, chemical etching, etc.

For one embodiment, the valve flap 508 dictates the size of the membrane 506, which includes the size of the main part of membrane 506 and the size of the hinge 510. For one embodiment, the valve flap has a diameter that is between 1.5 mm and 2 mm. For one embodiment, the valve flap 508 is a substantially rectangular or oblong shape with a length of 4 mm and a width of 6 mm. For a first example, and for one embodiment, the valve flap has a cross-sectional area between 1 $mm^2$ and 3 $mm^2$. For a second example, and for one embodiment, the valve flap 508 has a cross-sectional area between 1.75 $mm^2$ and 3.1 $mm^2$. For one embodiment, the size of the valve flap 508 can affect the level of reduction of an occlusion effect and the ability of a listener to manipulate perceived audio transparency. For a first example, and for one embodiment, a valve flap 508 with a size of 1.75 $mm^2$ can assist with improved occlusion reduction. For a second example, and for one embodiment, a valve flap 508 with a size of 3.1 $mm^2$ minimum can assist with improved perception of audio transparency because the opened valve flap 508A enables the BA based valve 500 to match open ear behavior, which occurs at sound frequencies that are approximately less than or equal to 1.0 kHz. For one embodiment, the shape of the valve flap 508 matches the cross sectional area of the connecting pathways to a listener's ear in a medial location and to the ambient environment in a lateral location to minimize acoustic reflections in the transmission line 520. For one embodiment, the shape of the valve flap 508 can be substantially rectangular, substantially circular, substantially oblong, or any variation or combination thereof. For a further embodiment, the shape of the valve flap 508 is dictated by one or more design constraints. For example, the design constraints described herein, the design constraints associated with manufacturing processes, etc.

For one embodiment, the armature 516 is a U-shaped armature or an E-shaped armature, as is known in the art. For one embodiment, the armature 516 is modified U-shaped armature with a crimp or a dimple (hereinafter "dimple") 532, which is illustrated in FIG. 5A. For one embodiment, the dimple 532 is formed in the U-shaped armature as at least one of a crimp, a cut-out section, a thinned section, or a dimple. For one embodiment, the dimple 532 converts an arm of the armature 516 that is between the magnets 522A-B into a movable arm of the armature 516. As a result, the movable arm of the armature 516 can assist with the bi-stable operation of the armature 516 because the movable arm can move in compliance with one or more forces created by the coil assembly 514 and the magnets 522A-B. For one embodiment, the dimple 532 is located anywhere on the movable arm of the armature 516 that is between the following two points: (i) a tangent point located at or near the beginning of the curved portion of the movable arm of the armature 516; and (ii) a point on the movable arm of the armature 516 that is closer to the drive pin 512 than the tangent point. For a first example, and for one embodiment, the dimple 532 is located anywhere within a portion 533 of the movable arm of the armature 516, as illustrated in FIG. 5A. For a second example, and for one embodiment, the dimple 532 is located within the first twenty-five percent (25%) of the length of the movable arm, as measured from the tangent point located at or near the beginning of the curved portion of the movable arm of the armature 516. For this embodiment, the dimple 532 can assist with reduction in a stiffness of the armature 516 so that the magnets 522A-B can attract or repel the armature 516 easily. For one embodiment, the dimple 532 can be included in any type of U-shaped armature that is used in any of the embodiments of a BA based valve as described herein—e.g., any of the BA based valves described in connection with FIGS. 5A-16. The dimple 532 can also be included in any type of U-shaped armature that is used in any known acoustic driver—e.g., the acoustic driver 400 described above in connection with FIG. 4.

For one embodiment, the armature 516 is an E-shaped armature. For this embodiment, the E-shaped armature 516 can assist with mechanically centering the armature 516 between the magnets 522A-B, which can enable bi-stable operation of the armature 516.

For one embodiment, the thickness, material, and formation process of the armature 516 will be defined to meet an excursion range for which the armature 516 will travel in the air gap 530 so as to move or collapse the armature 516 to either one of magnets 522A-B without causing damage or deformation to the armature 516. For one embodiment, the excursion range is between +0.006 inches and −0.006 inches, i.e., the total excursion range is 0.012 inches. For one embodiment, the excursion range is between +0.008 inches and −0.008 inches, i.e., the total excursion range is 0.016 inches. For one embodiment, the total excursion range is at least 0.012 inches. For one embodiment, the total excursion range is at most 0.016 inches. For one embodiment, the air gap 530 is at least approximately 0.020 inches. For one embodiment, the air gap 530 is at most approximately 0.020 inches. For one embodiment, the thickness of the armature 516 is at least 0.004 inches. For one embodiment, the thickness of the armature 516 is at most 0.008 inches. For one embodiment, the armature 516 is formed from a material that is magnetically permeable, such as a soft magnetic material. For example, and for one embodiment, the armature 516 is formed from at least one of nickel, iron, or any other magnetically permeable material known in the art. For one embodiment, the armature 516 includes multiple layers of magnetically permeable materials. For one embodiment, the armature 516 is formed by at least one of stamping or annealing.

For one embodiment, at least one of the components of the magnetic assembly of BA based valve 500 (which includes the coil assembly 514, the two magnets 522A-B, the pole piece 524, and the air gap 530) is formed from a material that is magnetically permeable, such as a soft magnetic material. For example, and for one embodiment, the pole piece 524 is formed from at least one of nickel, iron, or any other magnetically permeable material known in the art. For one embodiment, the pole piece is a multi-layer pole piece that has at least two layers of magnetically permeable materials. For one embodiment, at least part of the pole piece is formed by at least one of stamping, annealing, or metal injection molding.

For one embodiment, each of the magnets 522A-B includes at least one of aluminum, nickel, cobalt, copper, titanium, or a rare earth magnet (e.g., a samarium-cobalt magnet, a neodymium magnet, etc.). For one embodiment, each of the magnets 522A-B is designed to exhibit a low coercive force. For one embodiment, each of the magnets 522A-B is designed to be easily demagnetized to balance the armature 516 between the magnets 522A-B when necessary. For one embodiment, each of the magnets 522A-B is designed according to standards developed by the Magnetic Materials Producers Association (hereinafter "MMPA") and any other organizations that replaced or superseded the MMPA. Standards developed by the MMPA include, but are not limited to, the MMPA standard for Permanent Magnet Materials (MMPA 0100-00) and the MMPA Permanent Magnet Guidelines (MMPA PMG-88). For one embodiment, each of the magnets 522A-B includes at least one of aluminum, nickel, or cobalt. For one embodiment, each of the magnets 522A-B is an Alnico magnet. In a first example, and for one embodiment, each of the magnets 522A-B is an Alnico 5-7 magnet, which is defined in the MMPA 0100-00 or the MMPA PMG-88. In a second example, and for one embodiment, each of the magnets 522A-B is an Alnico 8 magnet, which is defined in the MMPA 0100-00 or the MMPA PMG-88. One advantage of the magnets 522A-B being Alnico 5-7 magnets is that the magnets 522A-B can be used for low reluctance circuits. One advantage of the magnets 522A-B being Alnico 8 magnets is that the magnets 522A-B can be used for high reluctance circuits.

For one embodiment, each of the terminal 518 and the connector 528 are formed from materials that enable electrical connections, as is known in the art. For one embodiment, the BA based valve 500 is included in an in-ear speaker.

Figure 5B:
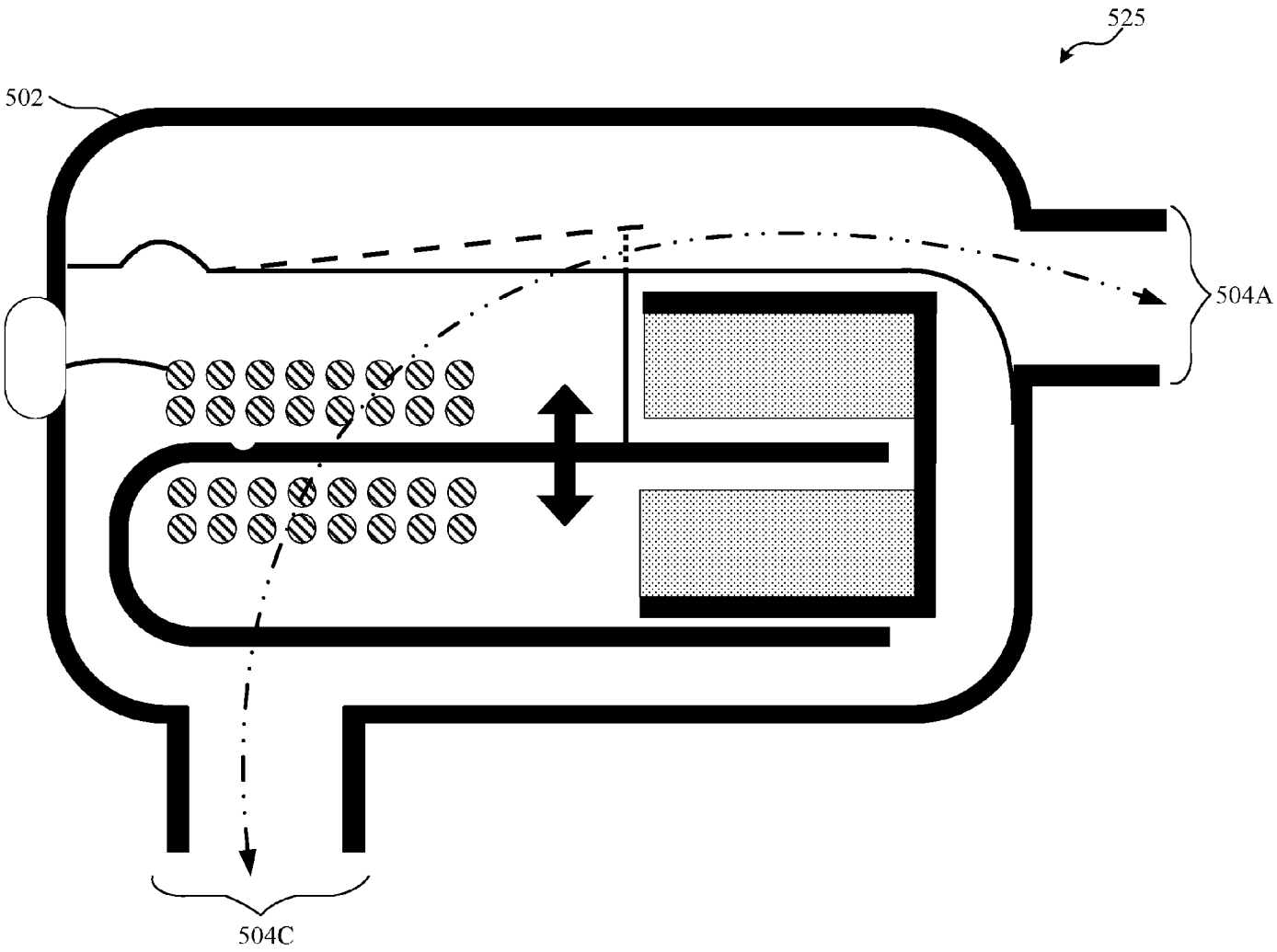
FIG. 5B is a cross-sectional side view illustration of another embodiment of a BA based valve.

FIG. 5B is a cross-sectional side view illustration of another embodiment of a BA based valve 525. The BA based valve 525 is a modification of the BA based valve 500 of FIG. 5B (which is described above in connection with FIG. 5A). For the sake of brevity, only the differences between the BA based valve 525 and the BA based valve 500 (which is described above in connection with FIG. 5A) are described below in connection with FIG. 5B.

One difference between the BA based valve 525 and the BA based valve 500 relates to the placement of the spout 504C. In FIG. 5A, the spout 504B is located on the rear side of housing 502. In contrast, spout 504C of FIG. 5B is located on the bottom side of housing 502. For one embodiment, the spout that is used for assisting with a reduction of an occlusion effect or manipulation of perceived audio transparency (e.g., the spout 504B of FIG. 5A, the spout 504C of FIG. 5B, etc.) can be located anywhere on the rear and bottom sides of housing 502.

For one embodiment, the two spouts of the BA based valves 500 and 525 can be located anywhere on the housing 502. For this embodiment, the membrane is substantially parallel to the top and bottom sides of the housing 502 and the two spouts are separated by the membrane 506. For a first example, and for one embodiment, the spout 504 A of FIGS. 5A and 5B is located anywhere on the housing 502 between the membrane 506 and the top side of the housing 502. In this example, and for this embodiment, the spout 504B of FIG. 5A or the spout 504C of FIG. 5B is located anywhere on the housing 502 between the membrane 506 and the bottom side of the housing 502. In this way, the valve flap 508 can be enabled to assist with mitigation of an occlusion effect or with manipulation of perceived audio transparency. For one embodiment, the BA based valve 525 is included in an in-ear speaker.

Figure 6A:
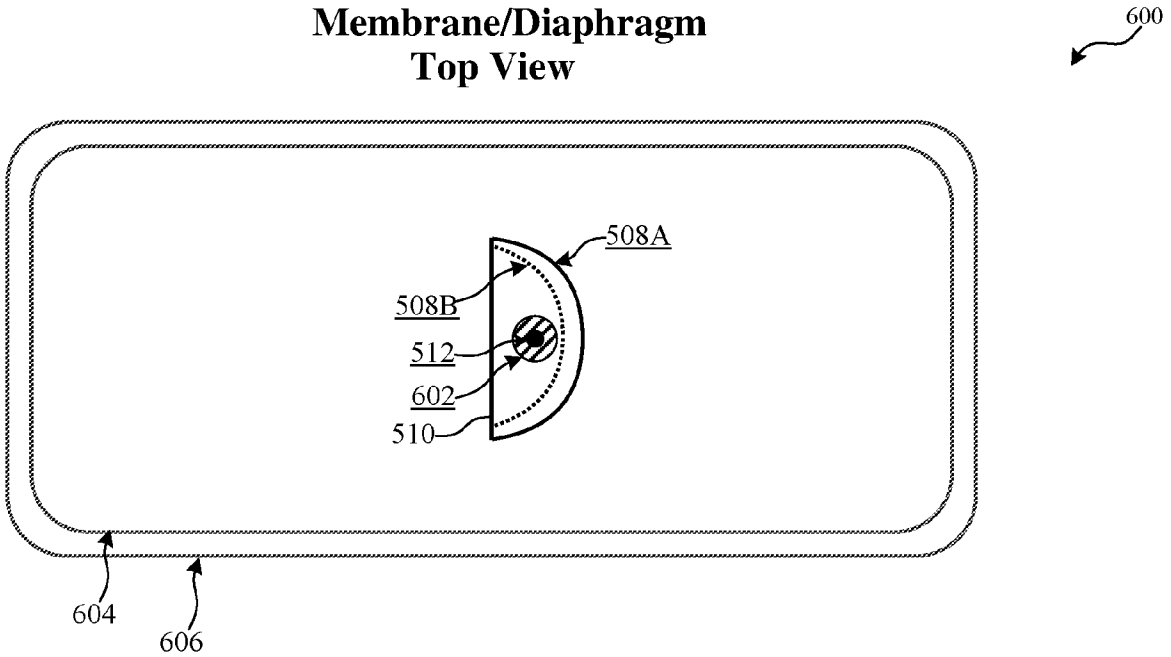
FIG. 6A is a cross-sectional top view illustration of one embodiment of a membrane or diaphragm (hereinafter "membrane") that is included in at least one of the BA based valves illustrated in FIGS. 5A-5B.

FIG. 6A is a cross-sectional top view illustration of one embodiment of a membrane 600 that is included the BA receivers illustrated in FIGS. 5A-5B. For one embodiment, the membrane 600 is similar to or the same as membrane 506, which is described above in connection with FIGS. 5A-5B, except that at least the location of the hinge 510 is different, because the flap 508 is more centrally located as seen in the top view of FIG. 6A. In the illustrated embodiment, the membrane 600 includes the valve flap 508 in the open position 508A and the closed position 508B, the drive pin 512, a primary membrane 604, a membrane frame 606, and an adhesive 602 that is used to secure the drive pin 512 to the valve flap 508. For one embodiment, the primary membrane 604 comprises the main part of the membrane 600 and the hinge (not shown), as described above in connection with FIGS. 5A-5B. For one embodiment, each of the valve flap 508, the primary membrane 604, and the membrane frame 606 is formed in accordance with the description provided above in connection at least one of FIGS. 5A-5B. For example, and for one embodiment, each of the valve flap 508 and the primary membrane 604 are made of at least one of nickel or aluminum. In this example, the primary membrane 604 is multi-layered with copper to immobilize the primary membrane 604, while the membrane frame 606 is formed from copper and used to encase the primary membrane 604 so as to further immobilize the primary membrane 604. Furthermore, and in this example, the valve flap 508 is not immobilized with copper, as described above in at least one of FIGS. 5A-5B.

Figure 6B:
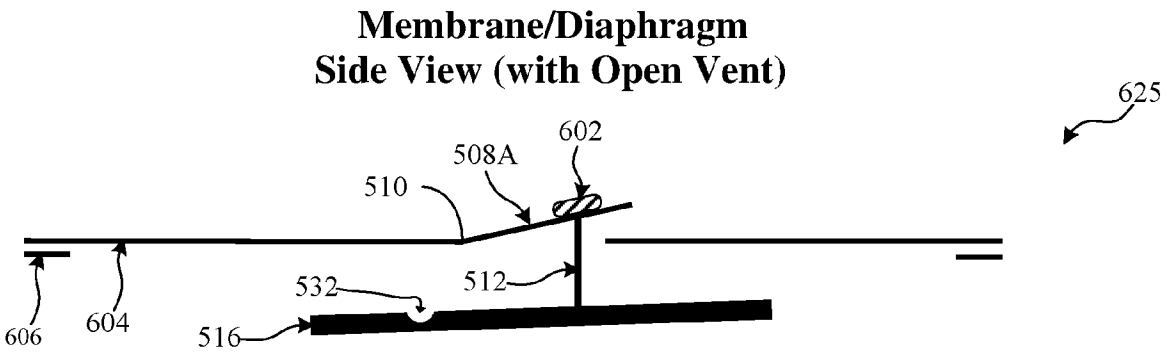
FIG. 6B is a cross-sectional side view illustration of the membrane illustrated in FIG. 6A.

FIG. 6B is a cross-sectional side view illustration of the membrane illustrated in FIG. 6A. For one embodiment, the adhesive 602 is used to secure the drive pin 512 to the valve flap 508. For one embodiment, the adhesive 602 is a polymer material, e.g., a compressed polymer material. For one embodiment, the adhesive 602 secures the drive pin 512 to the valve flap 508 by bonding or other processes known in the art. For one embodiment, a hole is formed in the valve flap 508 to enable the drive pin 512 to be secured to the valve flap 508 using the adhesive 602 or other securing mechanisms known in the art. It is to be appreciated that use of the adhesive 602 to secure the drive pin 512 to the valve flap 508 is merely exemplary. It is to be appreciated that other securing techniques (as known in the art) that are not disclosed herein can be used to secure the drive pin 512 to the valve flap 508.

Figure 7A:
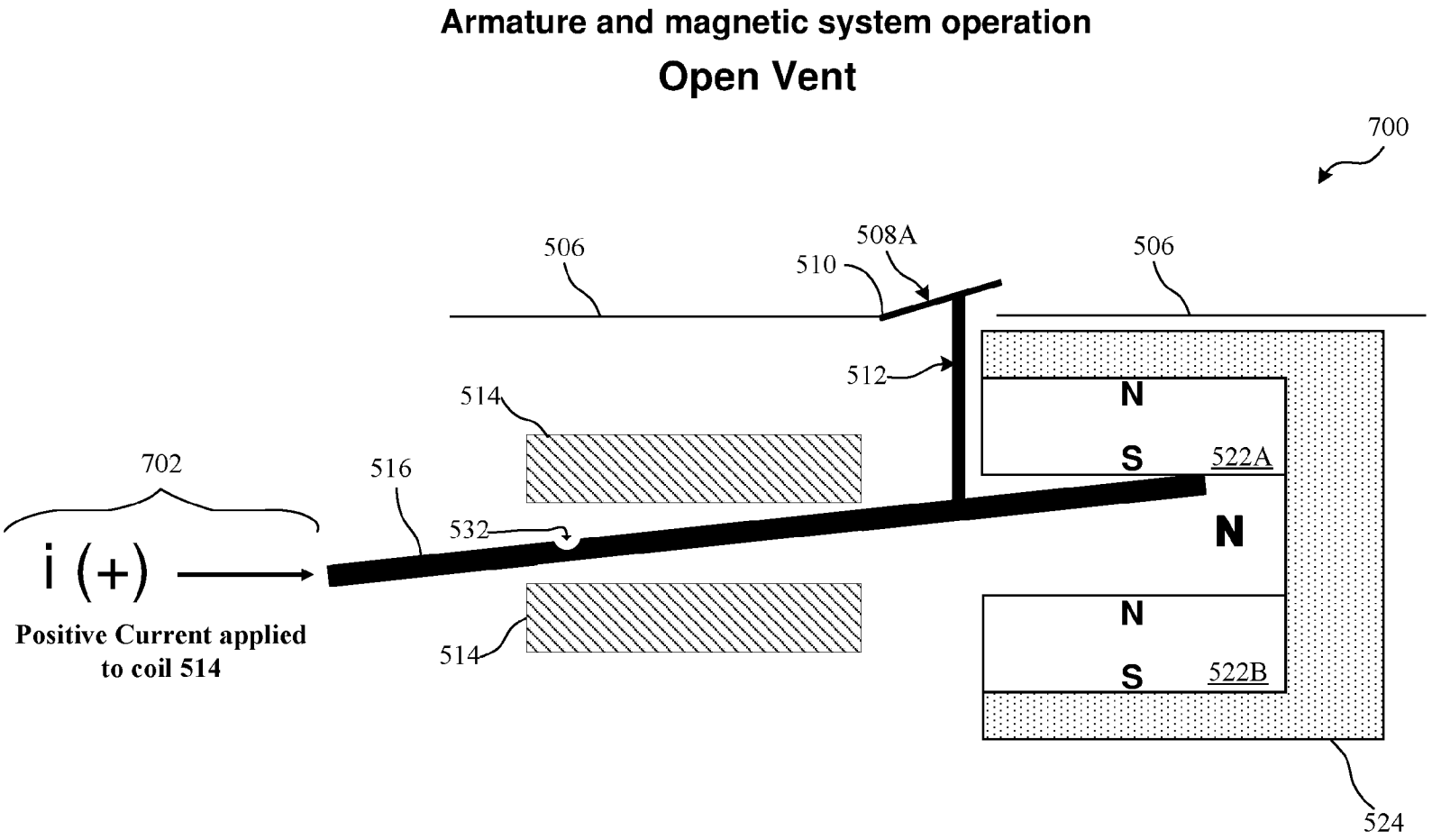
FIG. 7A is a block diagram side view illustration of one embodiment of a bi-stable operation of at least one of the BA based valves illustrated in FIGS. 5A-5B.

FIG. 7A is a block diagram side view illustration of one embodiment of a bi-stable state 700 of at least one of the BA based valves 500 and 525 illustrated in FIGS. 5A and 5B, respectively. In some embodiments of the BA based valves 500 and 525, an electrical input signal 702 is applied (in the form of a positive current, e.g., between +1 mA and +3 mA) to the coil assembly 514. For one embodiment, the coil assembly 514 creates a magnetic flux in response to the applied current and the magnetic flux moves the armature 516 upwards towards upper magnet 522A. For one embodiment, the upper magnet 522A has a magnetic field strength that attracts the upward moving armature 516 and causes the armature 516 to remain in direct contact with the upper magnet 522A. For this embodiment, the drive pin 512 actuates the valve flap 508 into the open position 508A as the armature 516 moves into direct contact with the upper magnet 522A. At this point, the current (electrical input signal 702) through the coil assembly 514 can now be reduced, e.g., down to zero, by a control circuit (not shown) that may be incorporated into the BA based valve 500, 525. In one embodiment, the control circuit accepts a continuous, low power logic control signal via the terminal 518 and connector 528, where the signal may have two stable states, one that commands an open state for the valve flap 508, and another that commands a closed state for the valve flap 508; this logic control signal may originate from an external electronic device (e.g., a smartphone, a computer, a wearable computer system, etc.) The control circuit converts the logic control signal into a short current pulse (electrical input signal 702) having the correct polarity as described below, to operate the coil assembly 514. For one embodiment, the control circuit can also include logic for receiving one or more input signals from the one or more sensors, as described above in connection with at least one of FIGS. 5A-5B.

Figure 7B:
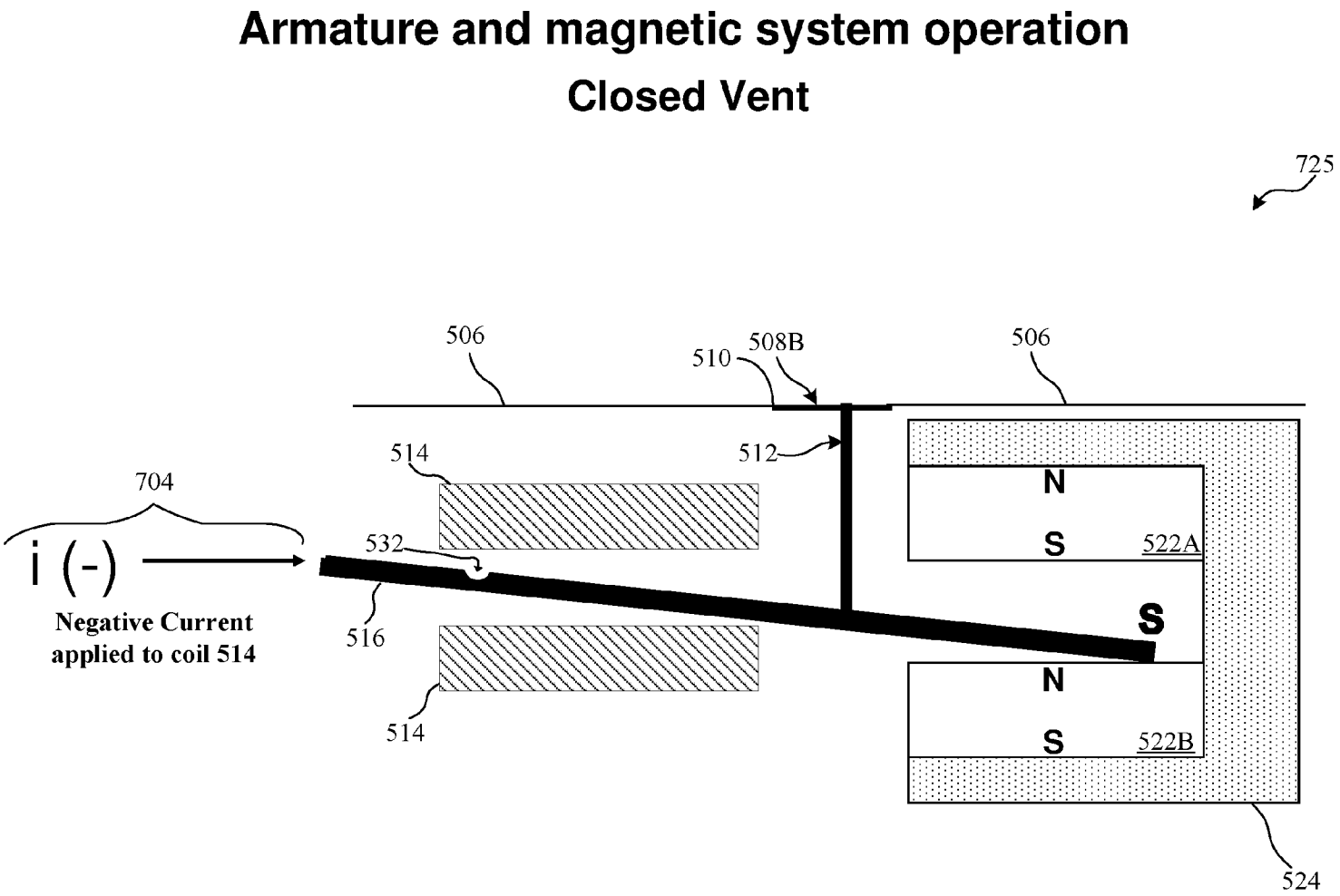
FIG. 7B is a block diagram side view illustration of one embodiment of another bi-stable operation of at least one of the BA based valves illustrated in FIGS. 5A-5B.

FIG. 7B is a block diagram side view illustration of one embodiment of another stable state 725 of at least one of the BA based valves 500 and 525 illustrated in FIGS. 5A and 5B, respectively. For some embodiments of the BA based valves 500 and 525, an electrical input signal 704 is applied (in the form of a negative current, e.g., between −1 mA and −3 mA) to the coil assembly 514. For one embodiment, the coil assembly 514 creates a magnetic flux in response to the applied current and the magnetic flux moves the armature 516 downwards towards the lower magnet 522B. For one embodiment, the lower magnet 522B has a magnetic field strength that attracts the downward moving armature 516 and causes the armature 516 to remain in direct contact with the lower magnet 522B. For this embodiment, the drive pin 512 actuates the valve flap 508 into the closed position 508B as the armature 516 moves into direct contact with the lower magnet 522B. At this point, the coil current (electrical input signal 704) can be reduced from its activation level, down to for example zero, by the control circuit that is incorporated into the BA based valves 500 and 525, as described above in connection with FIG. 7A.

Figure 8:
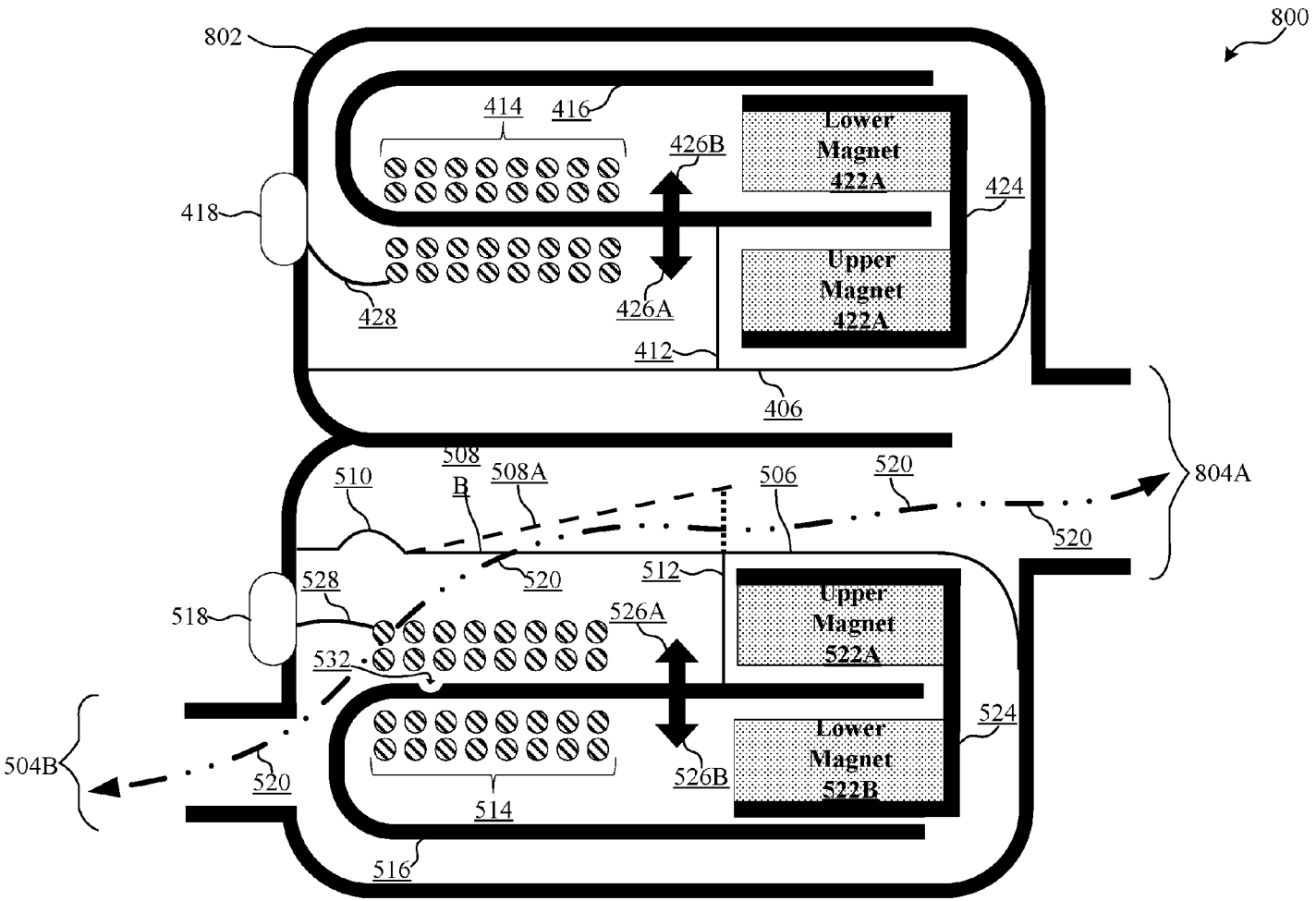
FIG. 8 is a cross-sectional side view illustration of one embodiment of a driver assembly that includes the BA based valve illustrated in FIG. 5A.

FIG. 8 is a cross-sectional side view illustration of one embodiment of a driver assembly 800 of the in-ear speaker, that includes the BA based valve 500 described above in connection with FIG. 5A, and the acoustic driver 400 described above in connection with FIG. 4. The illustrated embodiment of the driver assembly 800 is a combination of the BA based valve 500 and the acoustic driver 400 within a housing 802; however other embodiments are not so limited. For example, and for one embodiment, the driver assembly 800 includes at least one BA based valve 500 and at least one of (i) one or more BA receivers known in the art; or (ii) one or more acoustic drivers that are not BA receivers. For one embodiment, the housing 802 includes a first spout 804A that is to deliver sound that is output/generated by the acoustic drivers of the driver assembly 800 to an ear canal or to an ambient environment. For one embodiment, the housing 802 includes at least one second spout 504B that is to deliver unwanted sound created by an occlusion effect away from an ear canal, as described above in connection with FIG. 5A. For the sake of brevity, only those features, components, or characteristics that have not been described above in connection with FIGS. 1A-7B will be described below in connection with FIG. 8.

The driver assembly 800 includes a housing 802. For one embodiment, the housing 802 holds, encases, or is attached to one or more of the components of the BA receivers in the driver assembly 800. Furthermore, and for one embodiment, the housing 802 includes a top side, a bottom side, a front side, and a rear side. For one embodiment, the front side of the housing 802 is substantially parallel to the rear side of the housing 802. For one embodiment, the top side of the housing 802 is substantially parallel to the bottom side of the housing 802. When the driver assembly 800 is part of an in-ear speaker that is placed in a user's ear, the rear side of the housing 802 is further away from the user's ear canal than the front side of the housing 802 and the rear side of the housing 802 is closer to an ambient environment than the front side of the housing 802.

For one embodiment, the driver assembly 800 includes two spouts 804A and 504B, which may be formed on or coupled to the housing 802 as is known in the art. For one embodiment, the spout 804A performs the functions of the spout 504A of the BA based valve 500 and the functions of the spout 404 of the acoustic driver 400. The spouts 504A-504B are described above in connection with FIGS. 5A-5B. The spout 404 is described above in connection with FIG. 4.

In the illustrated embodiment of the driver assembly 800, the spout 804A is formed on or coupled to the front side of the housing 802; the spout 504B, a terminal 418, a terminal 518 are formed on or attached to the rear side of the housing 802; the spout 804A is equally close to the top and bottom sides of the housing 802; the spout 504B is farther from the top side of the housing 802; the spout 504B is closer to the bottom side of the housing 802; and the terminal 418 is closer to the top side of the housing 802.

For one embodiment, the driver assembly 800 combines an ability of the acoustic driver 400 to create sounds that are delivered to a listener's ear with an ability of the BA based valve 500 to reduce an occlusion effect and an ability of the BA based valve 500 to enable manipulation of perceived audio transparency. For one embodiment, the membrane 406 vibrates and thereby creates sounds based on an audio signal input provided as coil current, to the coil assembly 414, through the terminal 418 as described above in connection with FIG. 4. For one embodiment, the sounds created by the membrane 406 are emitted through the spout 804A into an ear of a listener or an ambient environment. For one embodiment, the valve flap 508 of the membrane 506, the spout 804A, and the spout 504B are used to release at least some of the amplified or echo-like sounds that result from an occlusion effect in the listener's ear through an uncovered hole in the membrane 506, as described above in at least one of FIGS. 5A-7B, in accordance with a valve drive or control signal received through another terminal, e.g., terminal 518. For one embodiment, the valve flap 508 of the membrane 506, the spout 804A, and the spout 504B are used to enable manipulation of perceived audio transparency, as described above in at least one of FIGS. 5A-7B. The spout 804A is thus shared as both a primary sound output port for an acoustic driver (producing sound in accordance with an audio signal received at terminal 418) and as a release port for releasing or venting (into the ambient environment through the spout 504B) the pressure of the amplified or echo-like sounds in the ear canal. For one embodiment, the reduction of the occlusion effect and the manipulation of the perceived audio transparency is based on one or more sensors, e.g., the sensors described above in at least one or FIGS. 5A-7B. For one embodiment, the driver assembly 800 is included in an in-ear speaker.

Figure 9:
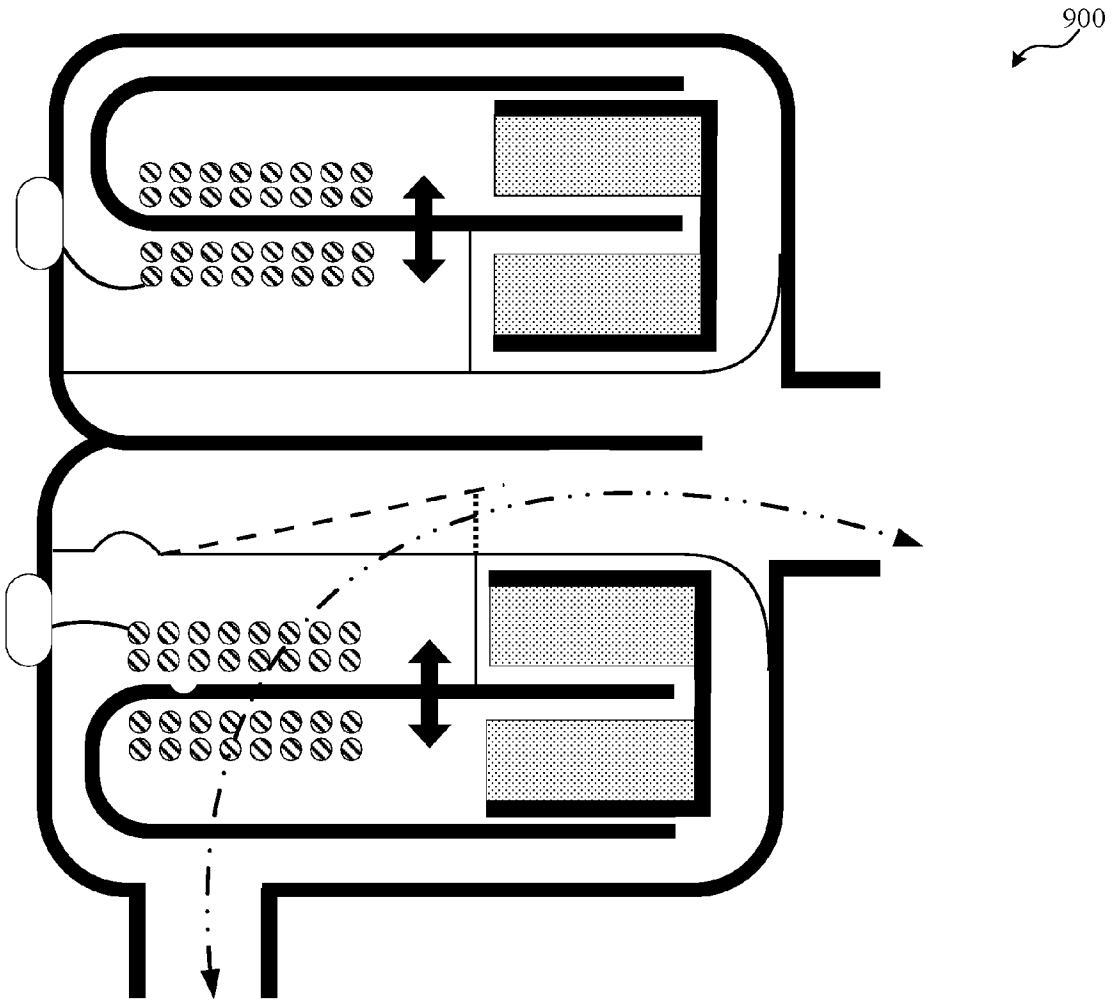
FIG. 9 is a cross-sectional side view illustration of one embodiment of a driver assembly that includes the BA based valve illustrated in FIG. 5B.

FIG. 9 is a cross-sectional side view illustration of one embodiment of a driver assembly 900 that includes the BA based valve 525 described above in connection with FIG. 5B and the acoustic driver 400 described above in connection with FIG. 4. For one embodiment, the driver assembly 900 is a modification of the driver assembly 800 described above in FIG. 8. The illustrated embodiment of driver assembly 900 is a combination of the BA based valve 525 and the acoustic driver 400 in the housing 802; however other embodiments are not so limited. For example, and for one embodiment, the driver assembly 900 includes at least one BA based valve 525 and at least one of (i) one or more BA receivers known in the art; or (ii) one or more acoustic drivers that are not BA receivers. For the illustrated embodiment, the housing 802 includes a first spout 804A and a second spout 504C. The spout 804A is described above in connection with FIG. 8 and the spout 504C is described above in connection with FIG. 5B. For one embodiment, the driver assembly 900 is included in an in-ear speaker. For the sake of brevity, reference is made to the descriptions provided above in connection with at least one of FIGS. 4, 5A-5B, or 8.

Figure 10A:
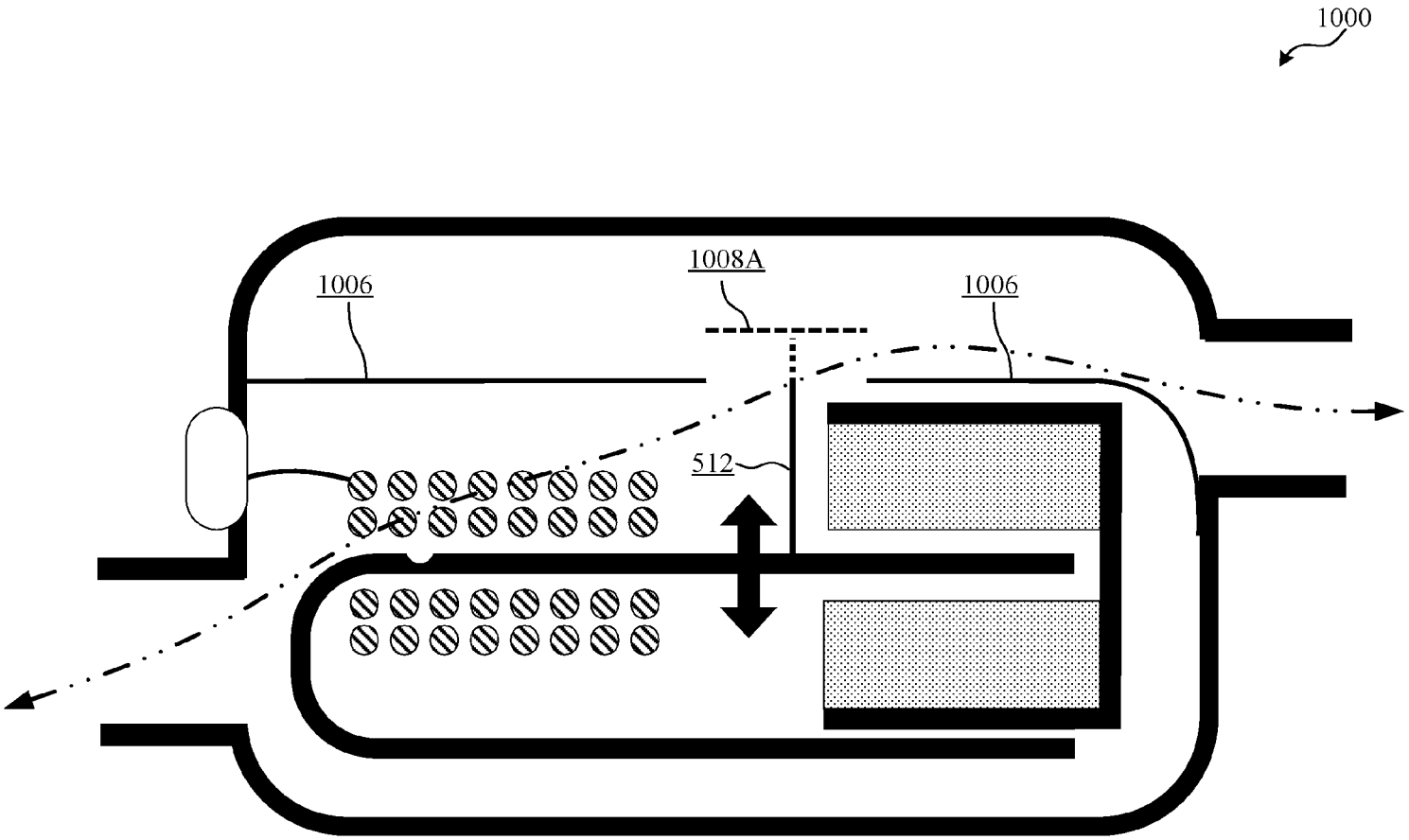
FIG. 10A is a cross-sectional side view illustration of yet another embodiment of a BA based valve.

FIG. 10A is a cross-sectional side view illustration of yet another embodiment of the venting or acoustic pass valve 210, as a BA based valve 1000. BA based valve 1000 may be viewed as a modification of the BA based valve 500 (which is described above in connection with FIG. 5A). For the sake of brevity, only the differences between the BA based valve 1000 and the BA based valve 500 (which is described above) will be described below in connection with FIG. 10A.

One difference between the BA based valve 1000 and the BA based valve 500 relates to the presence of the membrane 1006 including a detachable valve flap 1008, without the hinge 510. For one embodiment, the detachable valve flap 1008 of FIG. 10A differs from the valve flap 508 of FIG. 5A because at least one end of the valve flap 508 of FIG. 5A remains coupled to the membrane 506 of FIG. 5A, while the other end of the valve flap 508 is lifted by the driver pin 512 to uncover the hole (open the valve flap 508.) In contrast, the entirety of the detachable valve flap 1008 of FIG. 10A is lifted by the drive pin 512 (when uncovering the hole below it), so that the valve flap 1008 is completely detached from the main portion of the membrane 1006. Furthermore, there is no hinge 510 in the membrane 1006, which can reduce the number of components used to make the membrane. For one embodiment, the detachable valve flap 1008 of membrane 1006 is completely detached from the membrane 1006 into an open position 1008A, and re-attached to the membrane 1006 (abutting the top face of the main portion of the membrane and completely covering the hole therein) in a closed or sealed position (see FIG. 12B), in direct response to movement of the drive pin 512. For one embodiment, the BA based valve 1000 is included in an in-ear speaker, e.g., a sealing, insert-type in-ear speaker.

Figure 10B:
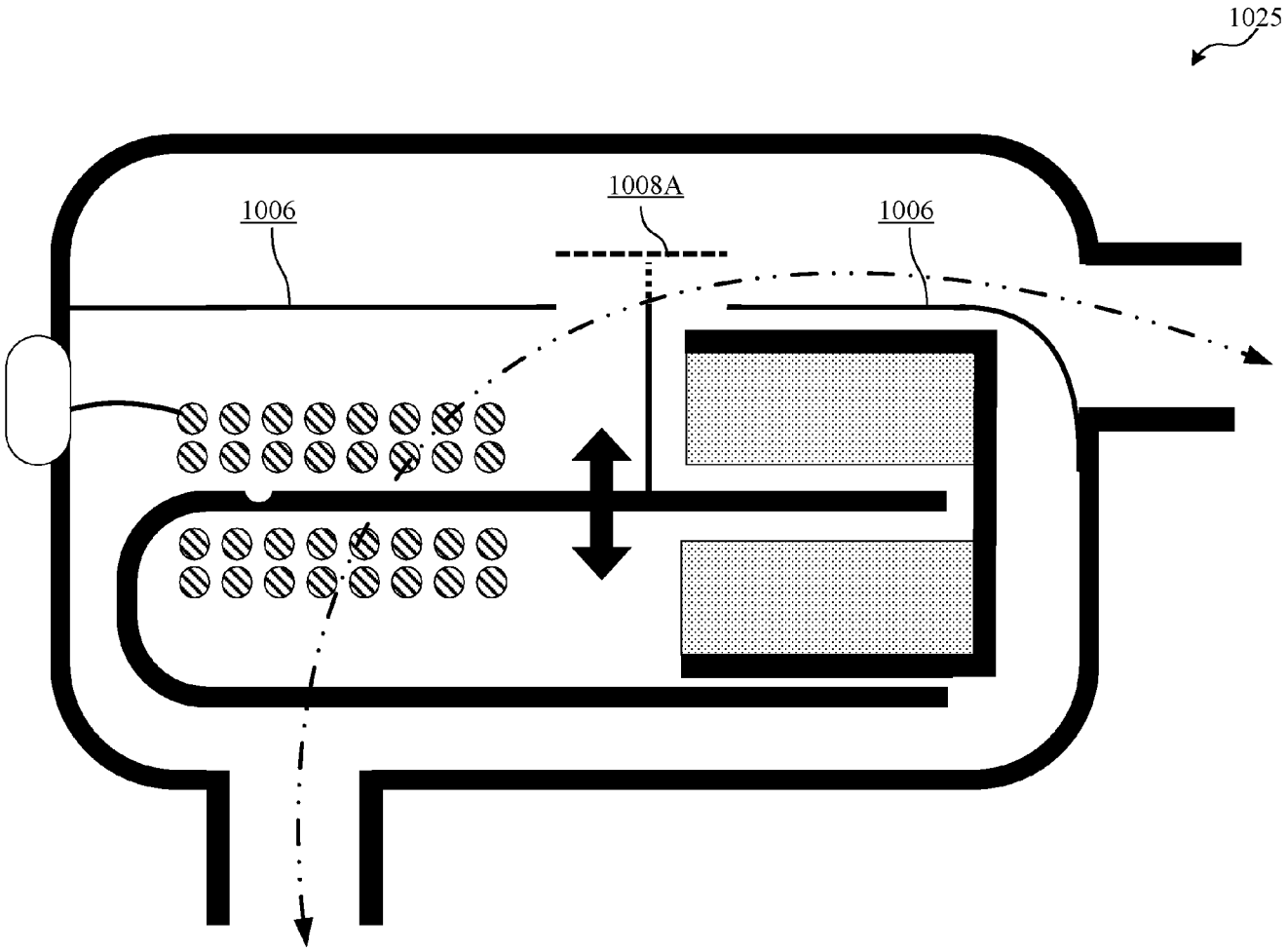
FIG. 10B is a cross-sectional side view illustration of one additional embodiment of a BA based valve.

FIG. 10B is a cross-sectional side view illustration of one additional embodiment of the valve 210, as a BA based valve 1025. BA based valve 1025 is a modification of BA based valve 525 (which is described above in connection with FIG. 5B). For the sake of brevity, only the differences between the BA based valve 1025 and the BA based valve 525 (which is described above) will be described below in connection with FIG. 10B.

One difference between the BA based valve 1025 and the BA based valve 525 relates to the presence of the membrane 1006 (including detachable valve flap 1008 without a hinge 510). The differences between the membrane 1006 and the membrane 506 are described above in connection with FIG. 10A. For one embodiment, the BA based valve 1025 is included in an in-ear speaker.

Figure 11A:
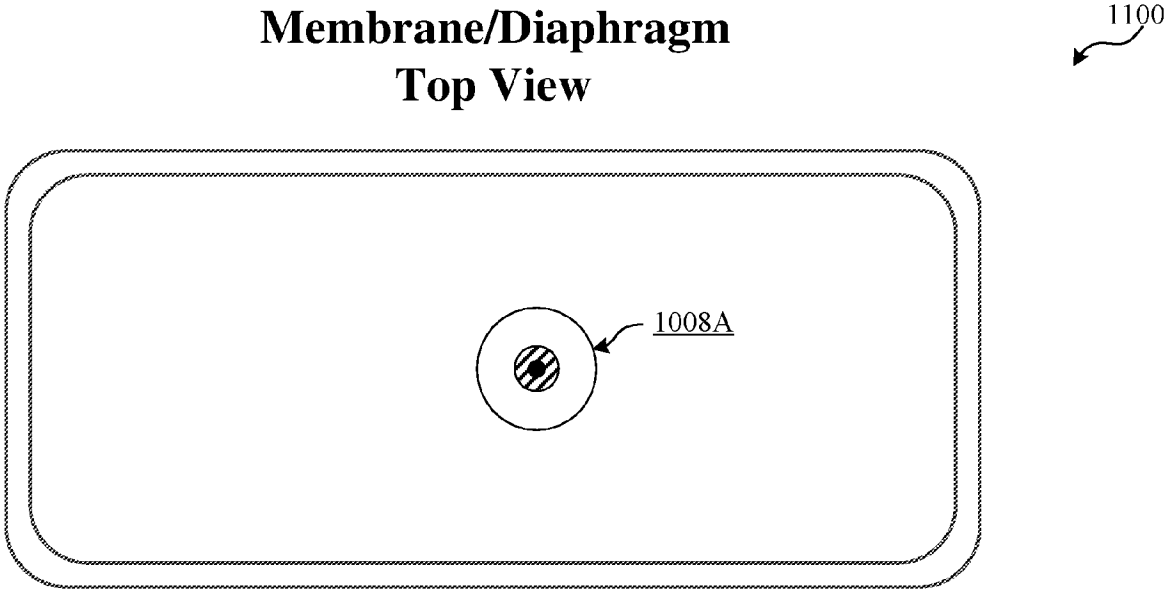
FIG. 11A is a cross-sectional top view illustration of one embodiment of a membrane that is included in at least one of the BA based valves illustrated in FIGS. 10A-10B.

FIG. 11A is a cross-sectional top view illustration of one embodiment of a membrane 1100 that is included in at least one of the BA based valves 1000 and 1025 illustrated in FIGS. 10A and 10B, respectively. For one embodiment, the membrane 1100 is a modification of membrane 600 described above in connection with FIG. 6A. One difference between the membrane 1100 and the membrane 600 relates to the presence of the detachable valve flap 1008 without the hinge 510. The differences between the membrane 1006 and the membrane 506 are described above in connection with FIG. 10A. For one embodiment, membrane 1100 is similar to or the same as membrane 1006, which is described above in connection with FIGS. 10A-10B. For the illustrated embodiment, the membrane 1100 includes the detachable valve flap 1008 in the open position 1008A, the drive pin 512, a primary membrane 604, a membrane frame 606, and an adhesive 602 that is used to secure the drive pin 512 to the detachable valve flap 1008. Each of these components is described above in connection with at least one of FIGS. 6A-10B. For one embodiment, the primary membrane 604 comprises the main part of the membrane without a hinge.

For one embodiment, each of the valve flap 508, the primary membrane 604, and the membrane frame 606 is formed in accordance with the description provided above in connection FIGS. 5A-5B except that there is no hinge.

Figure 11B:
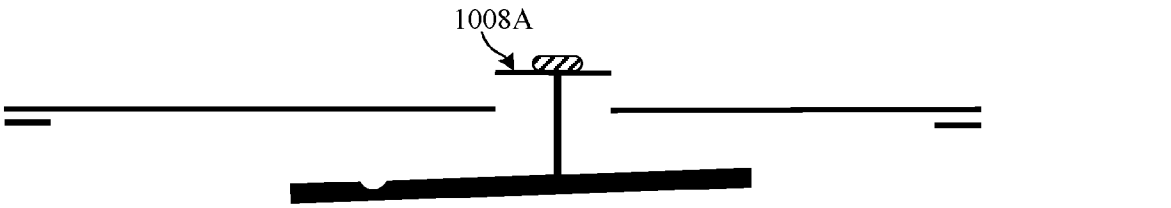
FIG. 11B is a cross-sectional side view illustration of the membrane illustrated in FIG. 11A.

FIG. 11B is a cross-sectional side view illustration of the membrane illustrated in FIG. 11A. The membrane illustrated by FIG. 11B is a modification of the membrane described above in connection with FIG. 6B. One difference between the membrane illustrated by FIG. 11B and the membrane described above in connection with FIG. 6B relates to the presence of the detachable valve flap 1008 without the hinge 510. The differences between the membrane 1006 and the membrane 506 are described above in connection with FIG. 10A. For the sake of brevity, reference is made to the descriptions provided above in connection with at least one of FIGS. 6B and 10A-11A.

Figure 12A:
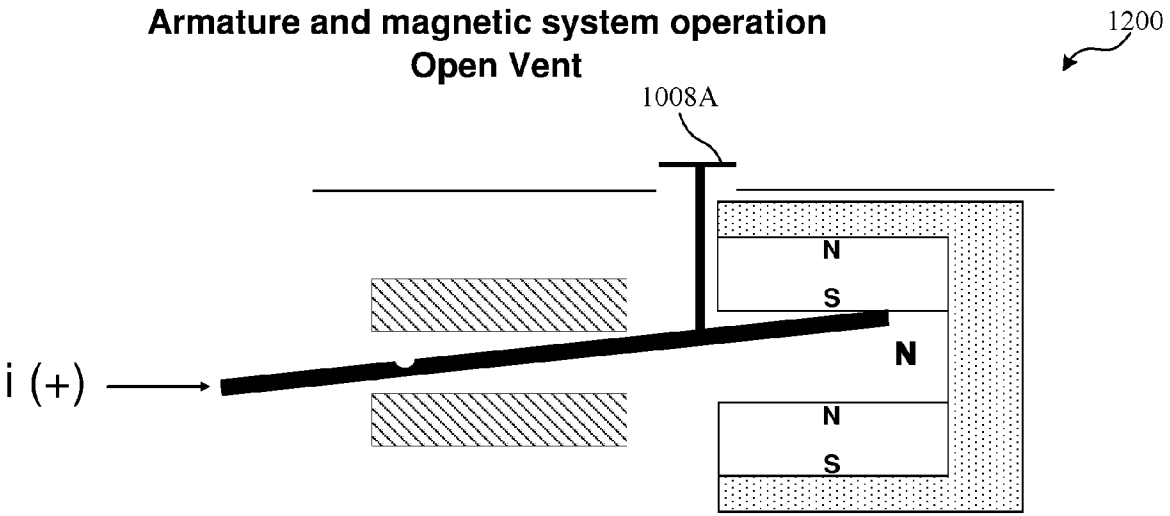
FIG. 12A is a block diagram side view illustration of one embodiment of a bi-stable operation of at least one of the BA based valves illustrated in FIGS. 10A-10B.

FIG. 12A is a block diagram side view illustration of one embodiment of a bi-stable operation 1200 of at least one of the BA based valves 1000 and 1025 illustrated in FIGS. 10A and 10B, respectively. The bi-stable operation 1200 is a modification of the bi-stable operation 700 described above in connection with FIG. 7A. One difference between the bi-stable operation 1200 and the bi-stable operation 700 described above in connection with FIG. 7A relates to the presence of the detachable valve flap 1008 without a hinge 510. The differences between the detachable valve flap 1008 and the valve flap 508 are described above in connection with FIG. 10A. For the sake of brevity, reference is made to the descriptions above in connection with FIGS. 7A and 10A-11B.

Figure 12B:
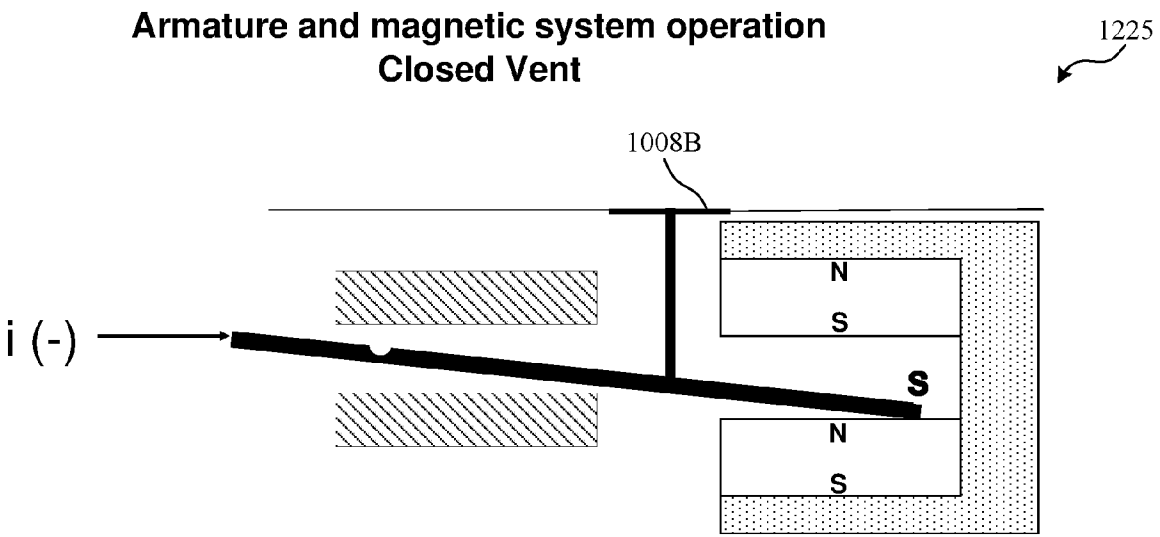
FIG. 12B is a block diagram side view illustration of one embodiment of another bi-stable operation of at least one of the BA based valves illustrated in FIGS. 10A-10B.

FIG. 12B is a block diagram side view illustration of one embodiment of another bi-stable operation 1225 of at least one of the BA based valves 1000 and 1025 illustrated in FIGS. 10A and 10B, respectively. The bi-stable operation 1225 is a modification of the bi-stable operation 725 described above in connection with FIG. 7B. One difference between the bi-stable operation 1225 and the bi-stable operation 725 described above in connection with FIG. 7B relates to the presence of the detachable valve flap 1008 without a hinge 510. The differences between the detachable valve flap 1008 and the valve flap 508 are described above in connection with FIG. 10A. For the sake of brevity, reference is made to the descriptions above in connection with FIGS. 7B and 10A-11B.

Figure 13:
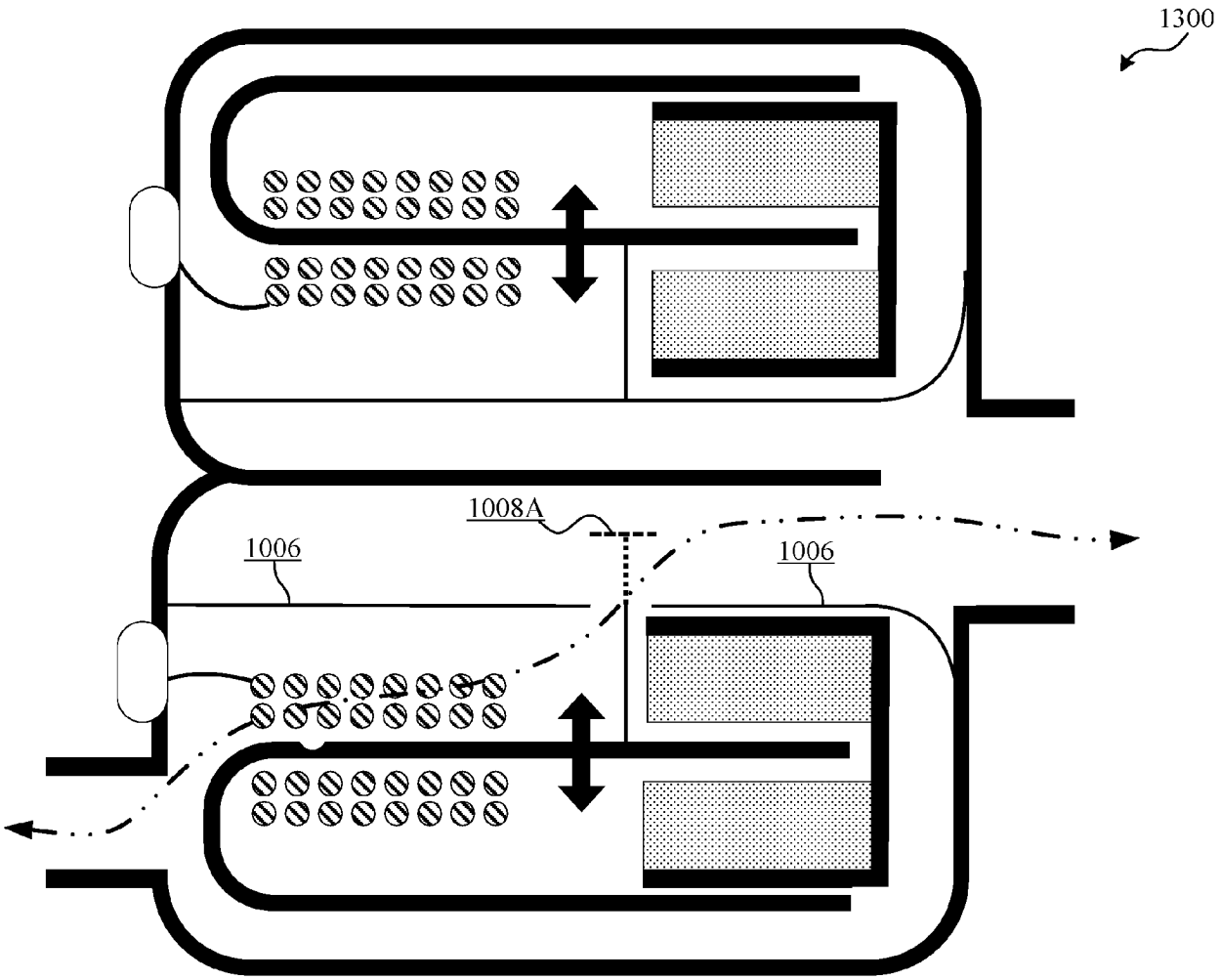
FIG. 13 is a cross-sectional side view illustration of one embodiment of a driver assembly that includes the BA based valve illustrated in FIG. 10A.

FIG. 13 is a cross-sectional side view illustration of one embodiment of a driver assembly 1300 that includes the BA based valve 1000 described above in connection with in FIG. 10A and the acoustic driver 400 described above in connection with FIG. 4. For one embodiment, the driver assembly 1300 is a modification of the driver assembly 800, which is described above in connection with FIG. 8. One difference between the driver assembly 1300 and the driver assembly 800 described above in connection with FIG. 8 relates to the presence of the detachable valve flap 1008 without a hinge 510. The differences between the detachable valve flap 1008 and the valve flap 508 are described above in connection with FIG. 10A. The illustrated embodiment of driver assembly 1300 is a combination of one embodiment of the BA based valve 1000 and the acoustic driver 400 in the housing 802; however other embodiments are not so limited. For example, and for one embodiment, the driver assembly 1300 includes at least one BA based valve 1000 and at least one of (i) one or more BA receivers known in the art; or (ii) one or more acoustic drivers that are not BA receivers. For one embodiment, the driver assembly 1300 is included in an in-ear speaker. For the sake of brevity, reference is made to the descriptions provided above in connection with at least one of FIG. 8 or 10A-12B.

Figure 14:
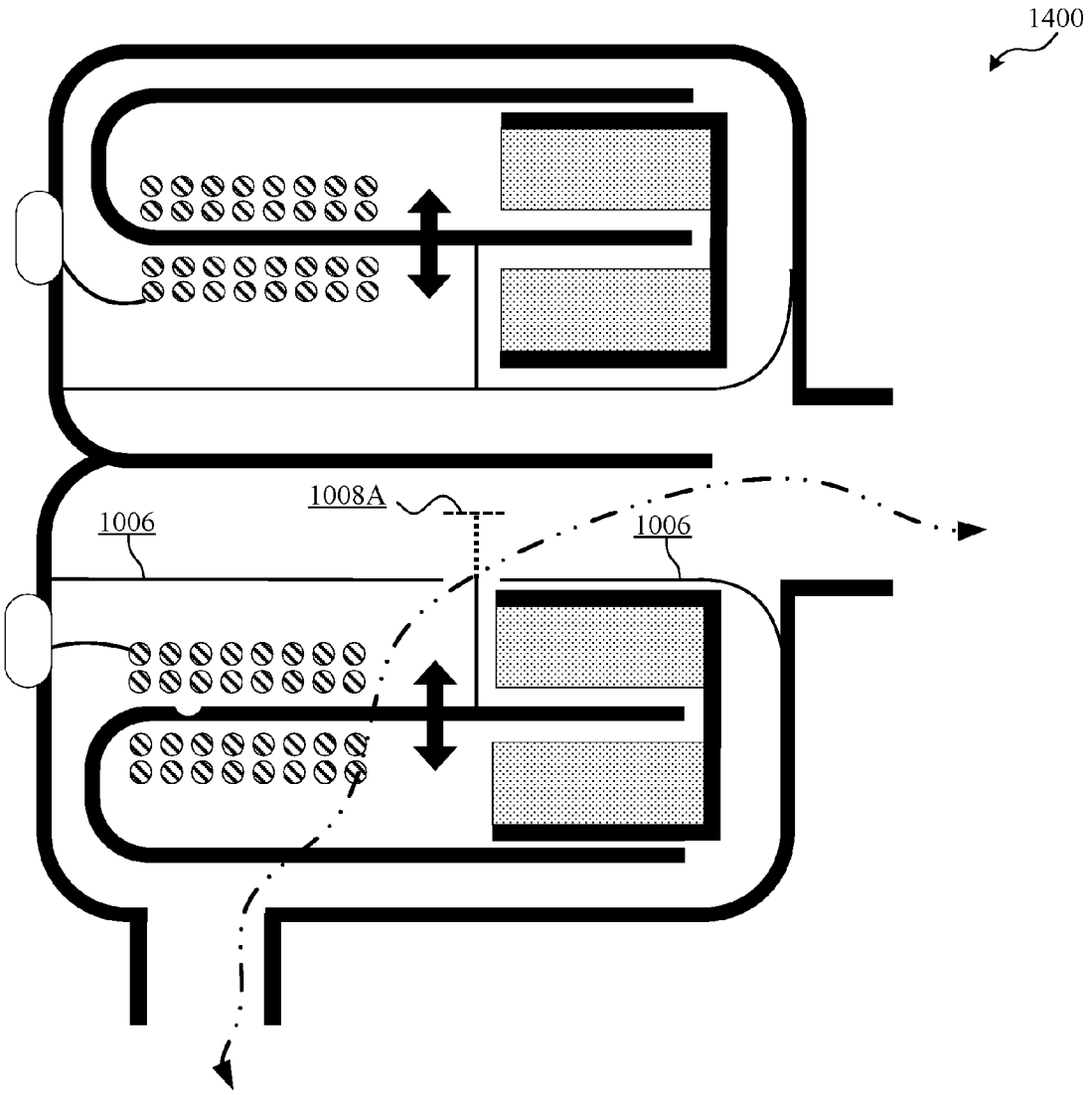
FIG. 14 is a cross-sectional side view illustration of one embodiment of a driver assembly that includes the BA based valve illustrated in FIG. 10B.

FIG. 14 is a cross-sectional side view illustration of one embodiment of a driver assembly 1400 that includes the BA based valve 1025 described above in connection with FIG. 10B and the acoustic driver 400 described above in connection with FIG. 4. For one embodiment, the driver assembly 1400 is a modification of the driver assembly 900 described above in connection with FIG. 9. One difference between the driver assembly 1400 and the driver assembly 900 described above in connection with FIG. 9 relates to the presence of the detachable valve flap 1008 without a hinge 510. The differences between the detachable valve flap 1008 and the valve flap 508 are described above in connection with FIG. 10A. The illustrated embodiment of driver assembly 1400 is a combination of one embodiment of the BA based valve 1025 and the acoustic driver 400 in the housing 802; however other embodiments are not so limited. For example, and for one embodiment, the driver assembly 1400 includes at least one BA based valve 1025 and at least one of (i) one or more BA receivers known in the art; or (ii) one or more acoustic drivers that are not BA receivers. For one embodiment, the driver assembly 1400 is included in an in-ear speaker. For the sake of brevity, reference is made to the descriptions provided above in connection with at least of FIG. 4, 10B, or 13.

Figure 15:
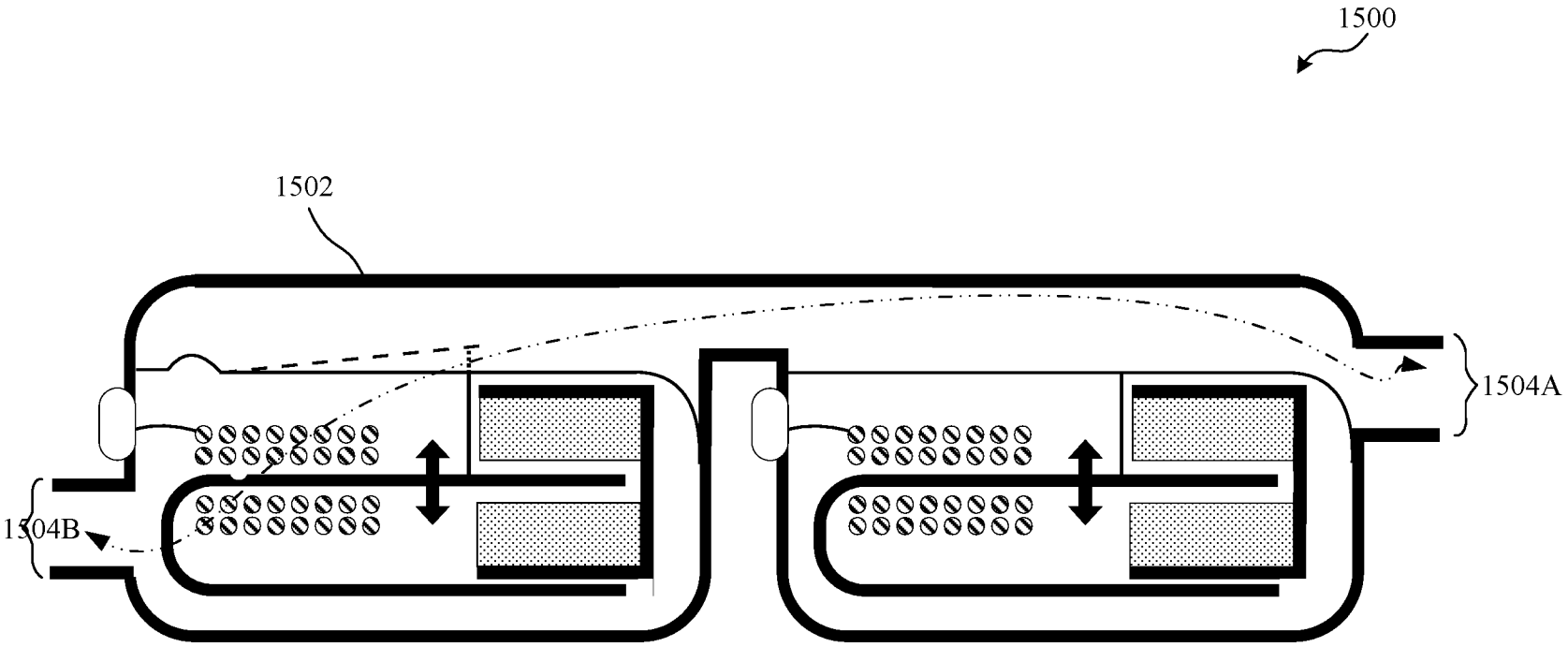
FIG. 15 is a cross-sectional side view illustration of yet another embodiment of a driver assembly that includes the BA based valve illustrated in FIG. 5A.

FIG. 15 is a cross-sectional side view illustration of yet another embodiment of a driver assembly 1500 that includes the BA based valve 500 described above in connection with in FIG. 5A and the acoustic driver 400 described above in connection with FIG. 4. For one embodiment, the driver assembly 1500 is a modification of the driver assembly 800, which is described above in connection with FIG. 8. One difference between the driver assembly 1500 and the driver assembly 800 (which is described above) is that, in the housing 1502 of the driver assembly 1500, the BA based valve 500 and the acoustic driver 400 are adjacently next to each other in an x-direction or a y-direction. This embodiment of the driver assembly 1600 can enable formation of driver assemblies with predetermined or specified z-heights. Accordingly, for one embodiment, the use of the housing 1502 to create the driver assembly 1500 may allow for an overall reduction of the z-height in size-critical applications.

The illustrated embodiment of the driver assembly 1500 is a combination of the BA based valve 500 and the acoustic driver 400 within a housing 1502; however other embodiments are not so limited. For example, and for one embodiment, the driver assembly 1500 includes at least one BA based valve that is described herein (e.g., BA based valve 500 or 525) and at least one of (i) one or more BA receivers known in the art; or (ii) one or more acoustic drivers that are not BA receivers. For one embodiment, the housing 1502 includes a first spout 1504A that is to deliver sound that is output/generated by the acoustic drivers of the driver assembly 1500 to an ear canal or to an ambient environment. For one embodiment, the first spout 1504A is similar to or the same as the spout 804A, which is described above in connection with FIG. 8A. For one embodiment, the housing 1502 includes at least one second spout 1504B that is to deliver unwanted sound created by an occlusion effect away from a listener's ear. For one embodiment, the second spout 1504B is similar to or the same as the spout 504B, which is described above in connection with FIG. 5A. For one embodiment, the driver assembly 1500 is included in an in-ear speaker.

Figure 16:
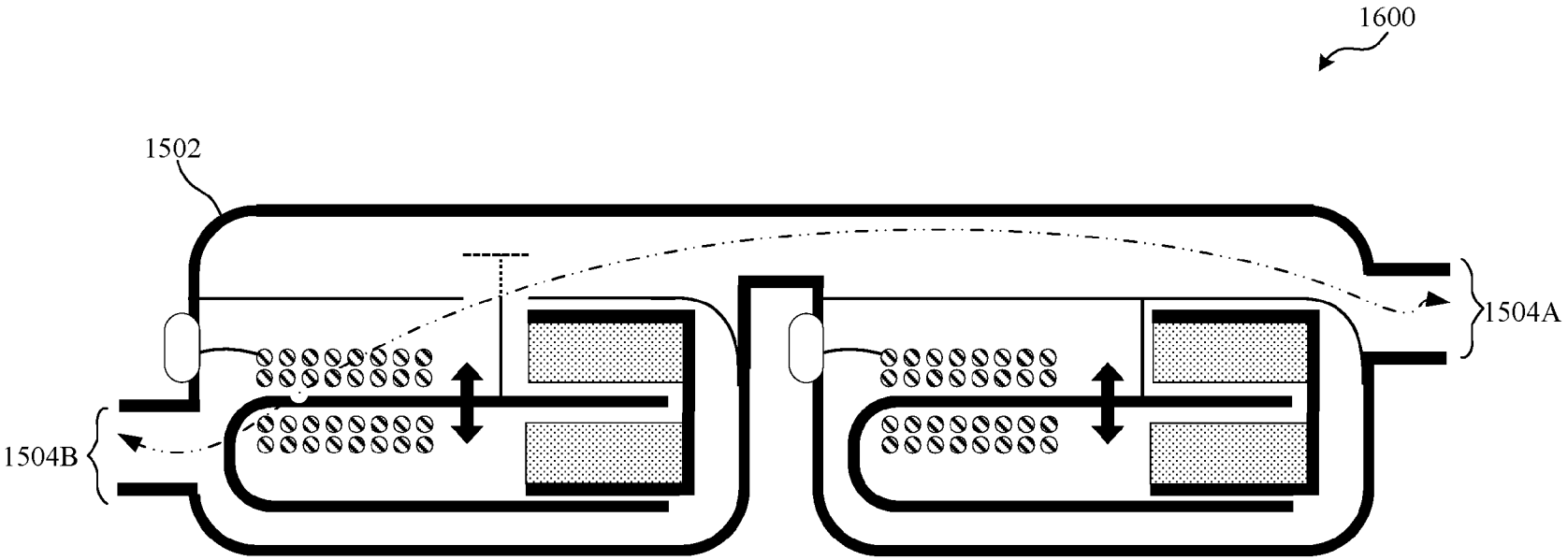
FIG. 16 is a cross-sectional side view illustration of another embodiment of a driver assembly that includes the BA based valve illustrated in FIG. 10A.

FIG. 16 is a cross-sectional side view illustration of another embodiment of a driver assembly 1600 that includes the BA based valve 1000 described above in connection with in FIG. 10A and the acoustic driver 400 described above in connection with FIG. 4. For one embodiment, the driver assembly 1600 is a modification of the driver assembly 1300, which is described above in connection with FIG. 13. One difference between the driver assembly 1600 and the driver assembly 1300 (which is described above) is that, in the housing 1502 of the driver assembly 1600, the BA based valve 1000 and the acoustic driver 400 are adjacently next to each other in an x-direction or a y-direction. This embodiment of the driver assembly 1600 can enable formation of driver assemblies with predetermined or specified z-heights. Accordingly, for one embodiment, the use of the housing 1502 to create the driver assembly 1600 may allow for an overall reduction of the z-height in applications that are size-critical.

The illustrated embodiment of the driver assembly 1600 is a combination of the BA based valve 1000 and the acoustic driver 400, within a housing 1502; however other embodiments are not so limited. For example, and for one embodiment, the driver assembly 1600 includes at least one BA based valve that is described herein (e.g., BA based valve 1000 or 1025) and at least one of (i) one or more BA receivers known in the art; or (ii) one or more acoustic drivers that are not BA receivers. For one embodiment, the housing 1502 of the driver assembly 1600 includes a first spout 1504A that is to deliver sound that is output/generated by the acoustic drivers of the driver assembly 1500 to an ear canal or to an ambient environment. For one embodiment, the first spout 1504A is similar to or the same as the spout 804A, which is described above in connection with FIG. 8A. For one embodiment, the housing 1502 of the driver assembly 1600 includes at least one second spout 1504B that is to deliver unwanted sound created by an occlusion effect away from a listener's ear. For one embodiment, the second spout 1504B is similar to or the same as the spout 504B, which is described above in connection with FIG. 5A. For one embodiment, the driver assembly 1600 is included in an in-ear speaker.

Additional Features for an Active Vent System

Figure 17:
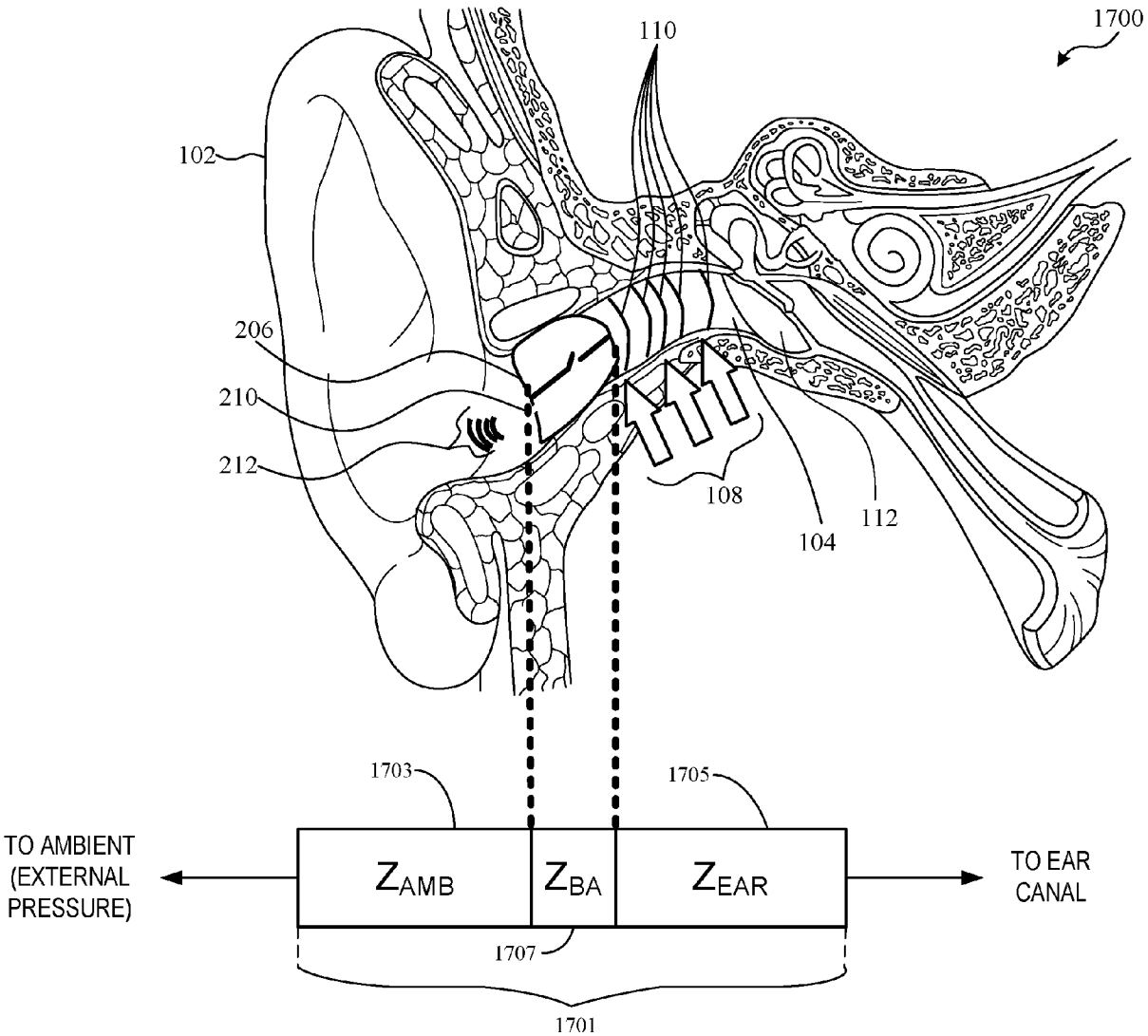
FIG. 17 is an illustration at least one embodiment of the BA based valve described above in connection with at least one of FIGS. 2 and 5A-16 being used as part of an in-ear speaker in accordance with one embodiment.

FIG. 17 illustrates how at least one embodiment of the venting or acoustic pass valve 210 described above in connection with at least one of FIGS. 2 and 5A-16 can be used as part of an active vent system 1700 in accordance with one embodiment. The active vent system 1700 includes the in-ear speaker 206 which contains the valve 210, different embodiments of which were described above in connection with FIGS. 2, 5A-16. For the sake of brevity, only the differences between the features of FIG. 2 and FIG. 17 will be described below in connection with FIG. 17.

As explained above in connection with at least one of FIGS. 2 and 5A-16, at least one embodiment of the BA based valve 210 includes at least two spouts, a membrane (including a valve flap and a hinge), an armature, a coil assembly, two magnets, a pole piece, and an air gap. For example, and for one embodiment, the valve flap of the membrane can be in an open position or a closed position to assist with reduction or elimination of amplified or echo-like sounds created by an occlusion effect, as well as, manipulation of perceived audio transparency.

For one embodiment, the active vent system 1700 is an acoustic system that couples an otherwise sealed ear canal to an external ambient environment (outside of an ear or an electronic device) using a pathway 1701. For one embodiment, the pathway 1701 is a network of volumes that include the BA based valve 210. For example, and for one embodiment, the active vent system 1700 requires a minimal pathway 1701 (i.e., a minimal amount of volumes that make up the pathway 1701) that includes a sealed ear canal volume, the BA based valve 210, and a volume representing the external ambient environment outside of an ear or an electronic device.

For one embodiment, a volume of the pathway 1701 is a dynamic air pressure confined within a specified three dimensional space, where this volume is represented as an acoustic impedance. Depending on the geometry of the volume, this acoustic impedance can behave like a compliance, inertance, (also known as "acoustic mass"), or a combination of both. The specified three dimensional space can be expressed in a tangible form as a tubular structure, a cylindrical structure, or any other type of structure with a defined boundary.

As shown in FIG. 17, the pathway 1701 can be the pathway used by the active vent system 1700. For one embodiment, the geometry of the pathway 1701 determines an overall effectiveness of the ability of the system 1700 to assist with reduction or elimination of amplified or echo-like sounds created by an occlusion effect, as well as, manipulation of perceived audio transparency. For example, the pathway 1701 can have a predetermined geometry that assists with reducing an occlusion effect and also with reducing any unwanted energy that builds up in the ear canal due to activity (e.g. running, footfalls, chewing, etc.) Each volume can be designed with a constant cross section and can resemble a structure of various cross section shapes. For one embodiment, the pathway 1701 includes at least three volumes 1703, 1705, and 1707. The first volume 1703 can be embodied in a tubular structure, a cylindrical structure, or any other structure with a defined boundary (not shown) that connects the BA based valve 210 of the in-ear speaker 206 to the ambient environment outside the ear 102. The second volume 1705 can be embodied in a tubular structure, a cylindrical structure, or any other structure with a defined boundary (not shown) that connects the BA based valve 210 of the in-ear speaker 206 to the ear canal 104 inside the ear 102. The third volume 1707 can be embodied as the BA based valve 210 itself.

For an embodiment, the centerline of the pathway 1701 could be circuitous, rectilinear, or any combination of having a simple or complex direction. Furthermore, the BA based valve 210 of the in-ear speaker 206 can be placed anywhere along the pathway 1701, either closer to the ear canal 104 or closer to the ambient environment outside the ear 102. For a specific embodiment, the valve flap of the BA based valve 210 is placed along the centerline of the pathway 1701.

For one embodiment, each of the volumes 1703, 1705, and 1707 of the pathway 1701 is quantified in terms of that specific volume's acoustic impedance (also known as acoustic mass). In this way, the entire pathway 1701 can be quantified using an overall acoustic impedance ($Z_{TOTAL}$). The use of acoustic impedance to describe each of the volumes 1703, 1705, and 1707 of the pathway 1701 is due to the fact that the presence or absence of acoustic impedance dominates the behavior and effectiveness of the active vent system 1700. The volume 1703 (which can be embodied in a structure that is not shown in FIG. 17) is quantified by its acoustic impedance $Z_{AMB}$, which represents the acoustic impedance of the structure connecting the BA based valve 210 to the ambient environment outside the ear 102. The volume 1705 (which can be embodied in a structure that is not shown in FIG. 17) is quantified by its acoustic impedance $Z_{EAR}$, which represents the acoustic impedance of the structure connecting the BA based valve 210 to the ear canal 104 inside the ear 102. The volume 1707 is quantified by its acoustic impedance $Z_{BA}$, which represents the acoustic impedance in the BA based valve 210 itself. For some embodiments, $Z_{BA}$ is considered to be negligible. For other embodiments, $Z_{BA}$ is a factor in the overall acoustic impedance ($Z_{TOTAL}$).

For one embodiment, and with regard to the pathway 1701, the formula for overall acoustic impedance ($Z_{TOTAL}$) is as follows:

$$Z_{TOTAL}=Z_{AMB}+Z_{BA}+Z_{EAR}$$

For one embodiment, the overall acoustic impedance ($Z_{TOTAL}$) is at least 500 $Kg/m^4$. For one embodiment, the overall acoustic impedance ($Z_{TOTAL}$) is at most 800,000 $Kg/m^4$. The concept of acoustic impedance or acoustic mass is well known to those skilled in the art, so a derivation and calculations for the ranges are not provided here.

In utilizing the various aspects of the embodiments described herein, it would become apparent to one skilled in the art that combinations or variations of the above embodiments are possible for forming in-ear speakers that include at least one of the BA based valves or the driver assemblies described herein. Although the embodiments described herein have been described in language specific to structural features and/or methodological acts, it is to be understood that the appended claims are not necessarily limited to the specific features or acts described. The specific features and acts disclosed are instead to be understood as embodiments of the claims useful for illustration.

It is to be appreciated that each of the devices, components, or objects illustrated in FIGS. 1-17 are not drawn to scale and that the sizes of these components are not necessarily identical. For example, the coil assembly 414 illustrated in FIG. 8 may or may not be identical in size and/or shape to the coil assembly 514 illustrated in FIG. 8.

The specification and drawings are, accordingly, to be regarded in an illustrative sense rather than a restrictive sense.

What is claimed is:

1. An acoustic pass valve for use in a speaker, the valve comprising:

a motor having a coil assembly and a magnetic system;

an armature extending through or being located adjacent to the coil assembly and the magnetic system;

a membrane having a main portion in which a hole is formed, and a moveable valve flap that, in a closed position, abuts a top face of the main portion and completely covers the hole;

a drive pin having a first end and a second end, the first end of the drive pin being coupled to the armature and the second end being coupled to the valve flap of the membrane, the valve flap to be actuated by the drive pin into i) an open position in which the hole is uncovered by the flap, in response to a first motion of the armature, and ii) the closed position, in response to a second motion of the armature;

a valve housing containing the motor, the armature, the drive pin, and the membrane;

a first spout coupled to or formed on the housing, wherein the first spout is open to a first space inside the housing that is open to a top face of the membrane; and a second spout coupled to or formed on the housing, wherein the second spout is open to a second space inside the housing that is open to a bottom face of the membrane.

2. The valve of claim 1, wherein each of the first and second motions of the armature do not cause the drive pin to actuate, vibrate, or move any part of the membrane that is not the valve flap.

3. The valve of claim 1, wherein the first motion of the armature causes the drive pin to actuate the valve flap into the open position in response to a first magnetic flux that is created when a positive current is applied to the coil assembly, the second motion of the armature causes the drive pin to actuate the valve flap into the closed position in response to a second magnetic flux that is created when a negative current is applied to the coil assembly, and the armature is bi-stable such that no current is applied to the coil assembly except to cause the first motion or the second motion.

4. The valve of claim 3, wherein when the valve flap is in the closed position, air pressure in the first space of the housing is sealed off from air pressure in the second space of the housing.

5. The valve of claim 3, further comprising:

logic to trigger the application of the positive or negative currents to the coil assembly based on one or more measurements by a sensor, wherein the logic is included in i) the valve, ii) an in-ear speaker in which the valve is contained, or iii) an external device that is to provide an audio signal to the in-ear speaker, and the sensor is included in i) the valve, ii) an in-ear speaker in which the valve is contained, or iii) an external device that is to provide an audio signal to the in-ear speaker.

6. The valve of claim 3, wherein the positive current is between +1 mA and +3 mA, and the negative current is between −1 mA and −3 mA.

7. The valve of claim 1, wherein the first motion of the armature ends due to the armature coming into contact with a first magnet of the magnetic system, the second motion of the armature ends due to the armature coming into contact with a second magnet of the magnetic system, and the armature is bi-stable such that no current through the coil assembly is required to maintain the armature at the end of the first motion or the second motion.

8. The valve of claim 7, wherein the magnetic system comprises the first magnet, the second magnet, and a pole piece, the pole piece being designed to hold the first and second magnets, the first magnet being directly over the second magnet with an air gap between the first and second magnets, and the armature being located in the air gap such that the first motion includes moving towards the first magnet and the second motion includes moving towards the second magnet.

9. The valve of claim 1 wherein a cross-sectional area of the valve flap is less than or equal to three $mm^2$.

10. The valve of claim 1, wherein the housing has a front side, a rear side, a top side, and a bottom side, the first spout is coupled to or formed on the front side of the housing or the top side of the housing, the second spout is coupled to or formed on the rear side of the housing or the bottom side of the housing, and wherein the front side, the bottom side, and the membrane are substantially parallel to each other, wherein the membrane is placed between the front and bottom sides of the housing and the motor, the armature, and the drive pin are between the membrane and the bottom side of the housing.

11. The valve of claim 1, wherein an active vent system couples an ear canal to an ambient environment outside of the speaker using a pathway, the valve being part of the active vent system, and the pathway includes at least three volumes through which the ear canal is acoustically coupled to the ambient environment, wherein a first one of the volumes presents an acoustic impedance between the valve and the ambient environment, a second one of the volumes presents an acoustic impedance between the valve and the ear canal, and a third one of the volumes presents an acoustic impedance in the valve itself.

12. The valve of claim 11, wherein an overall acoustic impedance of the at least three volumes is at least 500 $Kg/m^4$.

13. The valve of claim 11, wherein an overall acoustic impedance of the at least three volumes is at most 800,000 $Kg/m^4$.

* * * * *